US012140389B2

(12) United States Patent
Shen et al.

(10) Patent No.: US 12,140,389 B2
(45) Date of Patent: Nov. 12, 2024

(54) HEAT EXCHANGER AND HEAT EXCHANGE DEVICE

(71) Applicant: ZHEJIANG SANHUA AUTOMOTIVE COMPONENTS CO., LTD., Zhejiang (CN)

(72) Inventors: Qie Shen, Zhejiang (CN); Jiangtao Cui, Zhejiang (CN); Yixiang Yu, Zhejiang (CN); Yangjun Zhang, Zhejiang (CN)

(73) Assignee: ZHEJIANG SANHUA AUTOMOTIVE COMPONENTS CO., LTD., Zhejiang (CN)

( * ) Notice: Subject to any disclaimer, the term of this patent is extended or adjusted under 35 U.S.C. 154(b) by 571 days.

(21) Appl. No.: 17/439,518

(22) PCT Filed: Mar. 25, 2020

(86) PCT No.: PCT/CN2020/080996

§ 371 (c)(1),
(2) Date: Sep. 15, 2021

(87) PCT Pub. No.: WO2020/192666

PCT Pub. Date: Oct. 1, 2020

(65) Prior Publication Data

US 2022/0155031 A1 May 19, 2022

(30) Foreign Application Priority Data

Mar. 28, 2019 (CN) ..... 201920412311.7
Mar. 31, 2019 (CN) ..... 201910254425.8

(51) Int. Cl.
*F28F 9/02* (2006.01)
*F25B 39/04* (2006.01)
(Continued)

(52) U.S. Cl.
CPC ..... *F28F 9/0246* (2013.01); *F25B 39/04* (2013.01); *F28D 9/005* (2013.01); *F28D 2021/007* (2013.01)

(58) Field of Classification Search
CPC ..... F28F 9/0246; F28F 9/0209; F25B 39/04; F25B 2339/045; F28D 9/005; F28D 2021/007; F28D 9/0043; F28D 9/0093
(Continued)

(56) References Cited

U.S. PATENT DOCUMENTS 3,106,243 A 10/1963 Knudsen
3,590,917 A * 7/1971 Huber ..... F25J 3/04412 165/DIG. 373

(Continued)

FOREIGN PATENT DOCUMENTS

CN 200946997 Y 9/2007
CN 102494547 A 6/2012

(Continued)

OTHER PUBLICATIONS

KR 20150071171A, machine translation (Year: 2024).*

(Continued)

*Primary Examiner* — Eric S Ruppert
*Assistant Examiner* — Kirstin U Oswald
(74) *Attorney, Agent, or Firm* — Ohlandt, Greeley and Perle, L.L.P.

(57) ABSTRACT

A heat exchanger is provided, including a heat exchanger core. The heat exchanger core at least includes a first core part, a second core part and a third core part which are stacked. The first core part, the second core part and the third core part are formed by stacking plates. The third core part is located between the first core part and the second core part. The first core part is in the form of unilateral flow. The second core part is in the form of diagonal flow. The third (Continued)

core part can realize transformation of flow channel forms of the first core part and the second core part, and is stacked with the first core part and the second core part, and thus the heat exchange efficiency is good.

20 Claims, 16 Drawing Sheets

(51) Int. Cl.
*F28D 9/00* (2006.01)
*F28D 21/00* (2006.01)

(58) Field of Classification Search
USPC ..... 165/166
See application file for complete search history.

(56) References Cited

U.S. PATENT DOCUMENTS 3,945,434 A * 3/1976 Parker ..... F28D 9/0043 165/DIG. 359
4,002,201 A * 1/1977 Donaldson ..... F28F 3/04 165/166
4,131,159 A * 12/1978 Long ..... F28D 9/0025 165/DIG. 399
4,249,597 A * 2/1981 Carey ..... F28D 9/005 165/70
4,270,602 A * 6/1981 Foster ..... F28D 9/0037 29/890.039
5,016,707 A * 5/1991 Nguyen ..... F28F 3/086 165/DIG. 360
5,025,856 A * 6/1991 VanDyke ..... F28F 3/086 165/DIG. 360
5,355,947 A * 10/1994 Rasso, Jr. ..... F28F 9/0251 165/178
5,462,113 A * 10/1995 Wand ..... F28D 9/0093 165/140
5,964,280 A * 10/1999 Wehrmann ..... F28F 9/0246 165/145
7,343,965 B2 * 3/2008 Memory ..... F28D 9/005 165/166
2001/0025705 A1 * 10/2001 Nash ..... F28F 3/025 165/81
2001/0054501 A1 * 12/2001 Wehrmann ..... F28D 9/005 165/166
2004/0089438 A1 * 5/2004 Valensa ..... H01M 8/0631 165/4
2004/0159424 A1 * 8/2004 Reinke ..... F28F 13/08 165/140
2005/0082049 A1 * 4/2005 Brost ..... F28F 9/026 165/166
2006/0053833 A1 * 3/2006 Martins ..... F25B 39/04 62/507
2007/0125527 A1 * 6/2007 Flik ..... F28D 7/1692 165/140
2008/0066894 A1 * 3/2008 Valenzuela ..... H01L 23/473 257/E23.098
2013/0126149 A1 * 5/2013 Kim ..... F28D 9/0093 165/300
2013/0192291 A1 8/2013 Ito et al.
2013/0192806 A1 * 8/2013 Noishiki ..... F04D 29/5826 165/166
2014/0224455 A1 * 8/2014 Kalbacher ..... F28F 3/086 165/104.21
2015/0041110 A1 2/2015 Ito
2015/0252727 A1 * 9/2015 Aoki ..... F28D 7/1607 165/51
2015/0276320 A1 * 10/2015 Mueller ..... F28D 9/005 165/166
2016/0123676 A1 * 5/2016 Lee ..... F28D 9/005 165/166
2016/0327318 A1 * 11/2016 Kim ..... B60H 1/00342
2016/0356560 A1 12/2016 Wei et al.
2017/0184347 A1 * 6/2017 Ariyama ..... F28D 9/005
2019/0063846 A1 * 2/2019 Bluetling ..... F28D 9/0093

FOREIGN PATENT DOCUMENTS

CN 103759474 A 4/2014
CN 107218830 A 9/2017
CN 108731307 A 11/2018
CN 210154386 U 3/2020
DE 102014004322 A1 * 10/2015 ..... F28B 1/00
EP 0608195 A1 7/1994
FR 3059402 A1 6/2018
JP 2015014429 A 1/2015
KR 20110002139 A * 1/2011
KR 20110039977 A * 4/2011
KR 20130025516 A 3/2013
KR 20150071171 A * 6/2015
WO WO-2008063121 A1 * 5/2008 ..... F28D 1/0316
WO 2013080256 A1 6/2013
WO 2016176276 A1 11/2016

OTHER PUBLICATIONS

KR 20110039977A, machine translation (Year: 2024).*
KR-20110002139-A, machine translation (Year: 2024).*
DE-102014004322-A1, machine translation (Year: 2024).*
International Search Report dated Jun. 28, 2020 for PCT Appl. No. PCT/CN2020/080996.
European Office Action dated Dec. 13, 2023 for European Appl. No. EP 20 779 443.9.
European Search Report dated Oct. 24, 2022 for European Appl. No. EP 20 77 9443.

* cited by examiner

HEAT EXCHANGER AND HEAT EXCHANGE DEVICE

CROSS-REFERENCED APPLICATIONS

The application is the national phase of international Application No. PCT/CN2020/080996, titled "HEAT EXCHANGER AND HEAT EXCHANGE DEVICE", filed on Mar. 25, 2020, which claims the benefit of priorities to the following two Chinese patent applications: Chinese Patent Application No. 201920412311.7, titled "HEAT EXCHANGER AND HEAT EXCHANGE DEVICE", filed with the China National Intellectual Property Administration on Mar. 28, 2019; and Chinese Patent Application No. 201910254425.8, titled "HEAT EXCHANGER AND HEAT EXCHANGE DEVICE", filed with the China National Intellectual Property Administration on Mar. 31, 2019, both of which are incorporated herein by reference.

BACKGROUND

1. Field of the Disclosure

The present application relates to the technical field of heat exchange devices.

2. Discussion of the Background Art

A plate heat exchanger may be a unilateral flow heat exchanger as shown in FIG. 23 or a diagonal flow heat exchanger as shown in FIG. 24 according to the flow path of the heat exchange medium on the plate.

As long as the plate heat exchanger is determined to employ the unilateral flow heat exchange pattern or the diagonal flow heat exchange pattern, the positions of the corresponding ports of the heat exchanger is determined. Since different fluids is required to flow between adjacent pair of plates after the stacked arrangement of the plate heat exchanger is provided, heat exchange is required to be performed between the fluids flowing between the adjacent pair of plates. In order to change the positions of the inlet and outlet ports by providing both diagonal flow pattern and unilateral flow pattern in one plate heat exchanger, two plate heat exchangers are generally required, one of which employs the unilateral flow pattern, and the other employs the diagonal flow pattern. In the above manner, two heat exchangers and a component having an adapter structure are required, and the heat exchangers are connected to the adapter structure by pipelines, so there are many components and pipeline connections, and hence the overall structure will be large.

SUMMARY

In order to solve the above technical problems, a heat exchanger and a heat exchange device are provided according to the technical solutions of the present application, and the heat exchanger and heat exchange device have compact structures and good heat exchange efficiency.

A heat exchanger includes a heat exchanger core. The heat exchanger core includes at least a first core portion, a second core portion and a third core portion, each of the first core portion, the second core portion and the third core portion is formed by stacked plates. The third core portion is located between the first core portion and the second core portion. The first core portion is configured to have a unilateral flow pattern, and the second core portion is configured to have a diagonal flow pattern. The first core portion includes a first hole passage, and the second core portion includes a second hole passage. The heat exchanger core includes a first side portion and a second side portion, the first side portion and the second side portion are arranged opposite to each other, the first hole passage and the second hole passage are arranged adjacent to the first side portion, and the first hole passage and the second hole passage are arranged in a misaligned manner in a stacking direction of the plates.

A heat exchange device includes a liquid reservoir and the heat exchanger according to the above solution. The heat exchanger includes a first side plate and a second side plate, the heat exchanger core is located between the first side plate and the second side plate, the first core portion is a condensing portion, and the second core portion is a supercooling portion. The liquid reservoir is located at a side of the first side plate or a side of the second side plate, an inlet of the liquid reservoir is in communication with an internal flow passage of the condensing portion, and an outlet of the liquid reservoir is in communication with an internal flow passage of the supercooling portion.

DETAILED DESCRIPTION OF THE EMBODIMENTS

Figure 1:
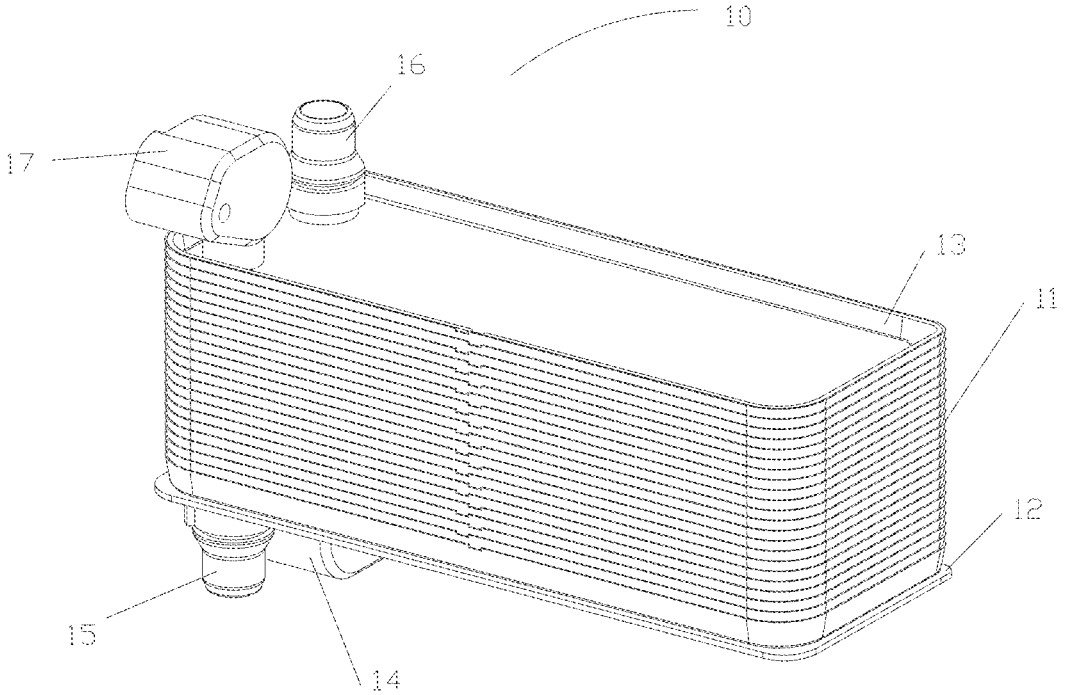
FIG. 1 is an overall schematic view of a heat exchanger according to an embodiment of the present application.

Specific embodiments will be described in detail with reference to the drawings. In order to fully understand the present application, numerous specific details are mentioned in the following detailed description. However, it should be understood by those skilled in the art that the specific components, devices, and features illustrated in the drawings and described herein are only exemplary and should not be considered as limitations.

A perforated member is defined as a member with a through hole for allowing a fluid to pass through. The most common pipes, a block with a through hole, etc. are all perforated members.

Figure 2:
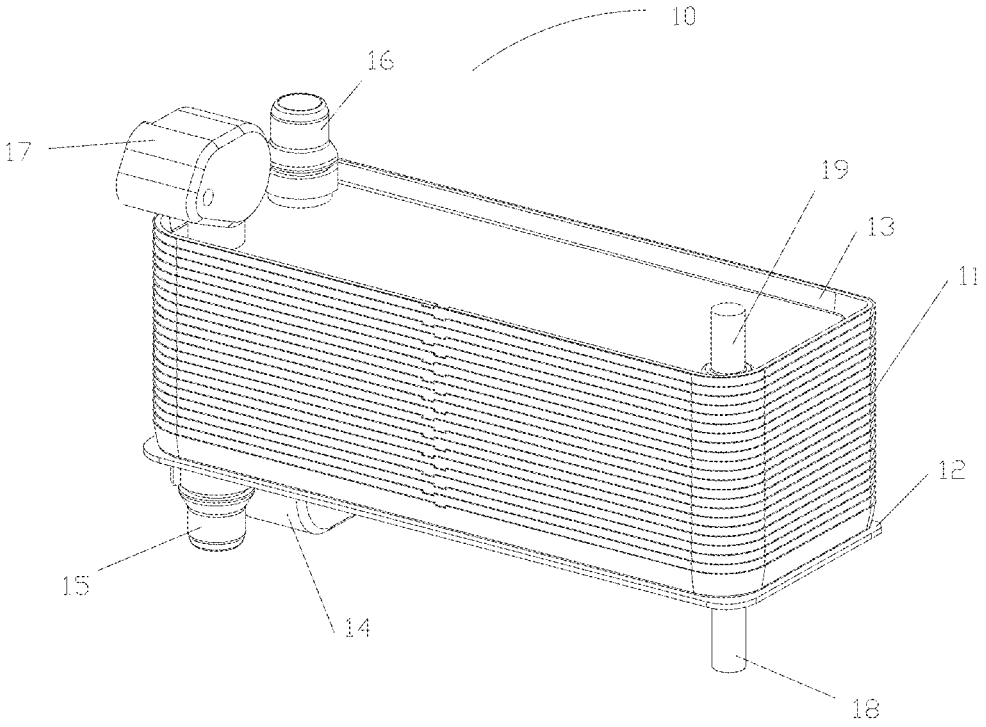
FIG. 2 is an overall schematic view of a heat exchanger according to another embodiment of the present application.

FIG. 1 shows a heat exchanger 10 according to the present application. An embodiment of the heat exchanger 10 is shown in FIG. 1, which includes a heat exchanger core 11, a first side plate 12, a second side plate 13, a first perforated member 14, a second perforated member 15, a third perforated member 16 and a fourth perforated member 17. Two sides of the heat exchanger core 11 are respectively fixed to the first side plate 12 and the second side plate 13 by welding. Another embodiment of the heat exchanger 10 is shown in FIG. 2, and the heat exchanger 10 shown in FIG. 2 further includes a fifth perforated member 18 and a sixth perforated member 19.

The first perforated member 14, the second perforated member 15, the third perforated member 16, the fourth perforated member 17, the fifth perforated member 18 and the sixth perforated member 19 are members each having a through hole, the members may all be pipes, or blocks with through holes, or may be part of pipes and part of blocks with through holes, or may be other forms of perforated members.

Figure 3:
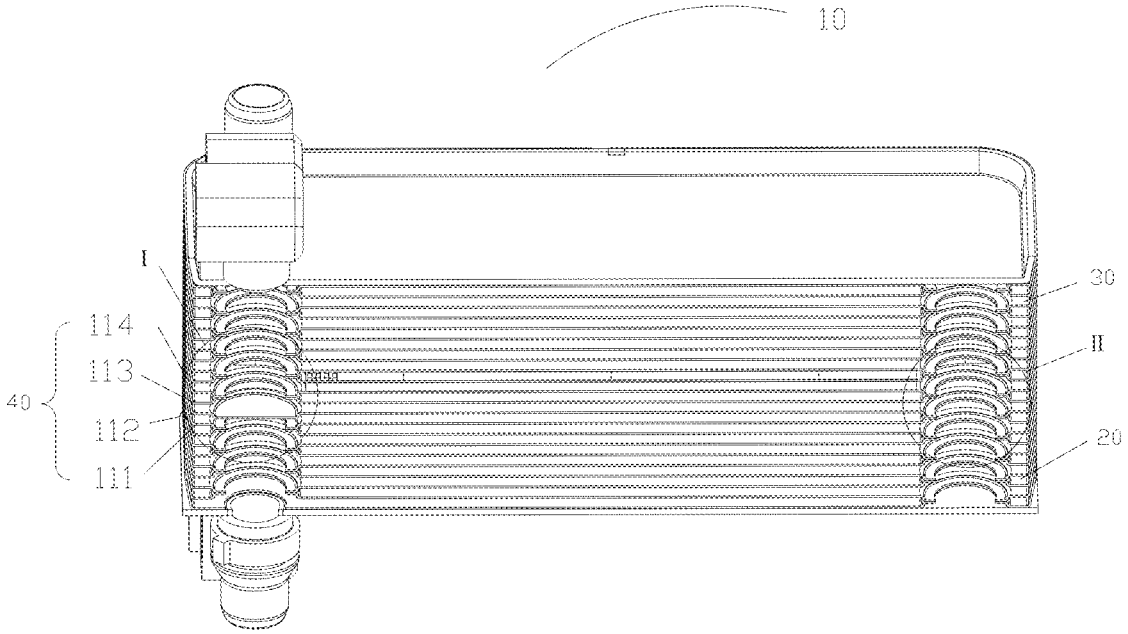
FIG. 3 is a sectional view of the heat exchanger in FIG. 1.

FIG. 3 shows a sectional view of the heat exchanger core 11 of the heat exchanger 10 shown in FIG. 1. The heat exchanger core 11 includes at least a first core portion 30, a third core portion 40 and a second core portion 20. The first core portion is configured to have a unilateral flow pattern, and the second core portion 20 is configured to have a diagonal flow pattern. The first core portion 30, the second core portion 20 and the third core portion 40 are formed by stacked plates. The third core portion 40 is located between the first core portion 30 and the second core portion 20.

Figure 21:
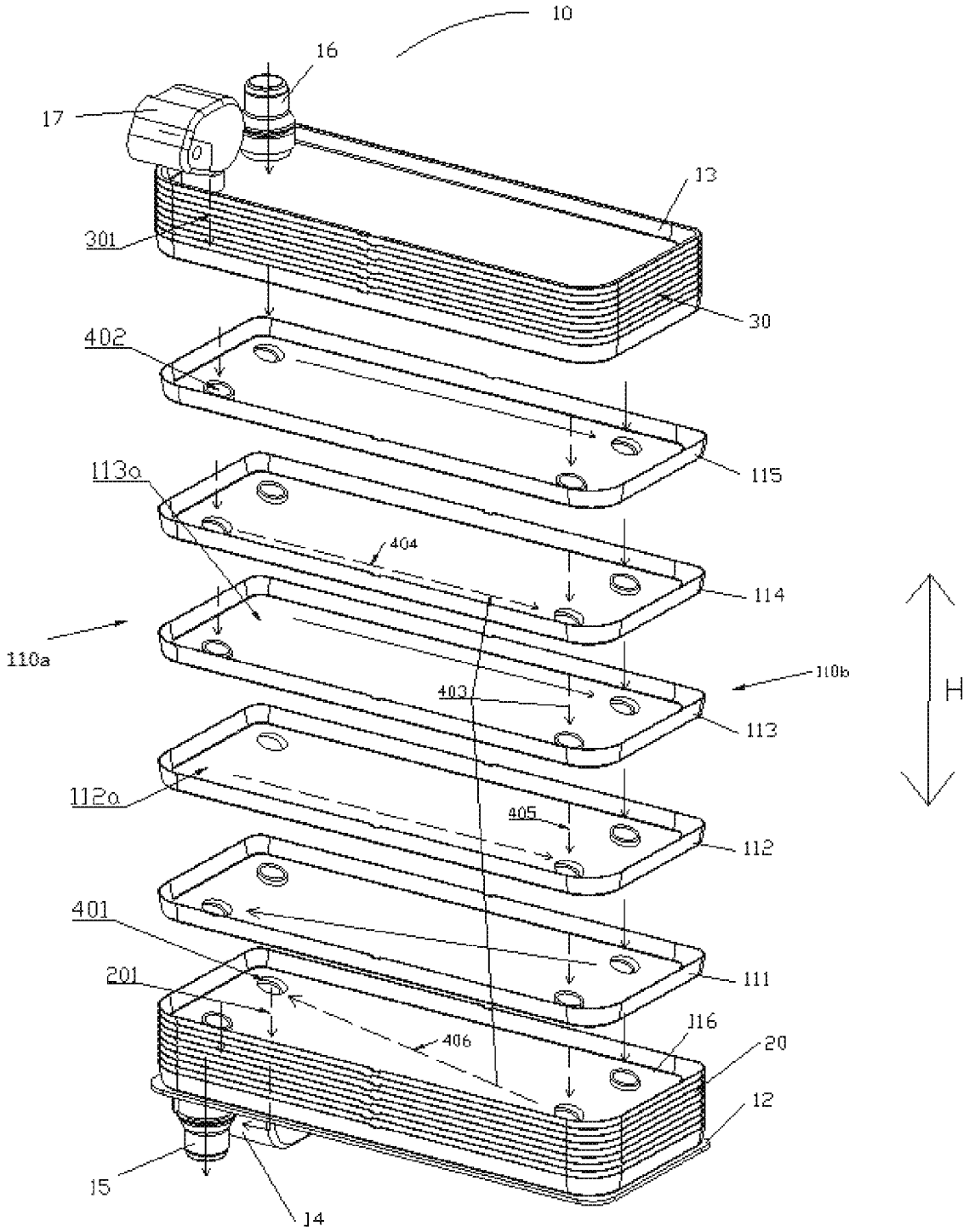
FIG. 21 is a schematic view showing a flowing state of each of heat mediums in a situation of the heat exchanger shown in FIG. 1.

Referring to FIG. 21, in order to more clearly show positions of hole passages, the positions shown by an arrows in the figure are the position of the hole passages. Of course, each of the hole passages is formed by alignment of holes of upper and lower stacked plates inside the heat exchanger, and the hole passages are merely schematically and roughly shown in the figure. The first core portion 30 includes a first hole passage 301, the second core portion 20 includes a second hole passage 201. The heat exchanger core includes a first side portion 110*a* and a second side portion 110*b*, the first side portion 110*a* and the second side portion 110*b* are arranged opposite to each other, the first hole passage 301 and the second hole passage 201 are arranged adjacent to the first side portion 110*a*, and the first hole passage 301 and the second hole passage 201 are arranged in a misaligned manner in a stacking direction H of the plates of the heat exchanger core 11. The third core portion 40 includes a first hole port 401 and a second hole port 402, the first hole port 401 and the second hole port 402 are adjacent to the first side portion 110*a*, and the first hole port 401 and the second hole port 402 are arranged in a misaligned manner in the stacking direction H of the plates of the heat exchanger core 11. The second hole port 402 is in communication with the first hole passage 301, and the first hole port 401 is in communication with the second hole passage 201. The third core portion 40 includes at least a first plate 112 and a second plate 113, the first plate 112 includes a first blocking portion 112*a*, the second plate 113 includes a second blocking portion 113*a*, the first blocking portion 112*a* is located at a position corresponding to the second hole port 402, and the second blocking portion 113*a* is located at a position corresponding to the first hole port 401. In the stacking direction H of the heat exchanger, the first blocking portion 112*a* blocks a flow passage in the first plate 112 which is located at the position corresponding to the second hole port 402, and the second blocking portion 113*a* blocks a flow passage in the second plate 113 which is located at the position corresponding to the first hole port 401. The third core portion 40 includes a fluid passage 403, an end port of the fluid passage 403 is the first hole port 401, and another end port of the fluid passage 403 is the second hole port 402. The fluid passage 403 includes at least a first path 404, a second path 405 and a third path 406, the first path 404 extends in a direction from the first side portion 110*a* to the second side portion 110*b*, the second path 405 extends in the stacking direction H of the heat exchanger core, and the third path 406 extends in a direction from the second side portion 110*b* to the first side portion 110*a*. Herein, the first path, the second path and the third path are similar to paths indicated by arrows as shown in the drawings, and are the flow paths of the fluid inside the heat exchanger.

Herein, for the convenience of description, it is defined that the heat exchanger core includes a first side portion and a second side portion, but the heat exchanger core is not limited to have an approximately rectangular structure. In some cases, the heat exchanger core may have an approximately circular structure, in these cases, the first side portion and the second side portion may be defined by virtually delimiting an approximately rectangular structure according to the positions of the holes in the heat exchanger core, and the positions of the first side portion and the second side portion may be delimited by connecting lines between of the positions of the holes.

The fluid passage 403 of the third core portion 40 includes at least the first path 404, the second path 405 and the third path 406, in this way, the fluid can flow through the first hole passage 301, the second hole port 402, the first path 404, the second path 405, the third path 406, and the second hole passage 201. The fluid flows through the first core portion 30, the second core portion 20 and the third core portion 40, and the fluid can perform heat exchange in the first core portion 30, the second core portion 20 and the third core portion 40. In the heat exchanger, the fluid can flow from the first hole passage 301 to the second hole passage 201, and the heat exchange of the fluid is realized in the heat exchanger core, which has a good heat exchange efficiency. Besides, plates having the unilateral flow pattern and the diagonal flow pattern are employed in the same heat exchanger, thus the overall structure is compact.

More specifically, the third core portion 40 includes the first plate 112, the second plate 113, a third plate 111, a fourth plate 114, a fifth plate 115 and a sixth plate 116. The fourth plate 114 and the fifth plate 115 are stacked at a side where the second plate 113 is located, and the third plate 111 and the sixth plate 116 are stacked at a side where the first plate 112 is located. The first path 404 is located between the fourth plate 114 and the fifth plate 115, or the first path 404 is located between the fourth plate 114 and the second plate 113. The first path 404 may be an internal flow passage of the first core portion, and the first path may be in the form of unilateral flow. The second path 405 is adjacent to the second side portion 110*b*. The third path 406 is located between the first plate 112 and the second plate 113, or the third path 406 is located between the first plate 112 and the third plate 111, or the third path 406 is located between the third plate 111 and the sixth plate 116. The third path 406 may be an internal flow passage of the second core portion 20, and the third path 405 may be in the form of diagonal flow.

The unilateral flow pattern in the first core portion is converted into the diagonal flow pattern in the second core portion via the third core portion, so that a fluid port of the first core portion and a fluid port of the second core portion can be located on the same side of the heat exchanger, which meets the requirement that the ports of the heat exchanger should be on the same side.

The fifth plate 115, the third plate 111, the first plate 112, the second plate 113, the fourth plate 114 and the sixth plate 116 are adjacent to one another in a listed sequence. A distance between the first side plate 12 and the third plate 111 is smaller than a distance between the first side plate 12 and the fourth plate 114. The fifth plate 115 is arranged in cooperation with the fourth plate 114 to form a flow passage of the plate heat exchanger, the structure of the fifth plate is similar to that of the fourth plate 114, and the specific structure of the fifth plate will not be described in detail here. The sixth plate is arranged in cooperation with the third plate to form a flow passage of the plate heat exchanger, the structure of the sixth plate is similar to that of the third plate 111, and the specific structure of the sixth plate will not be described in detail here.

Figure 4:
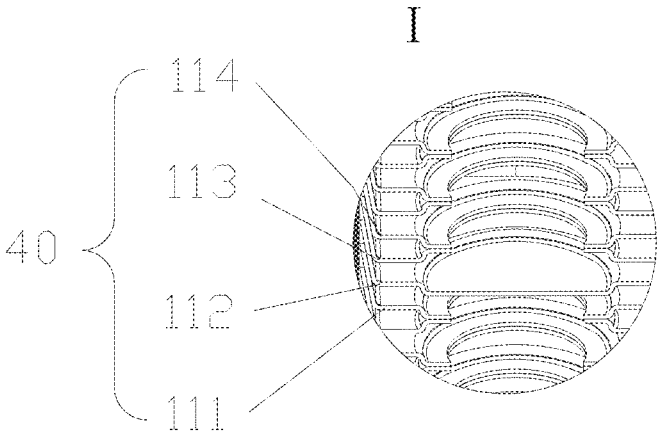
FIG. 4 is a view, partially enlarged at position I, of the sectional view of the heat exchanger of FIG. 3.
Figure 5:
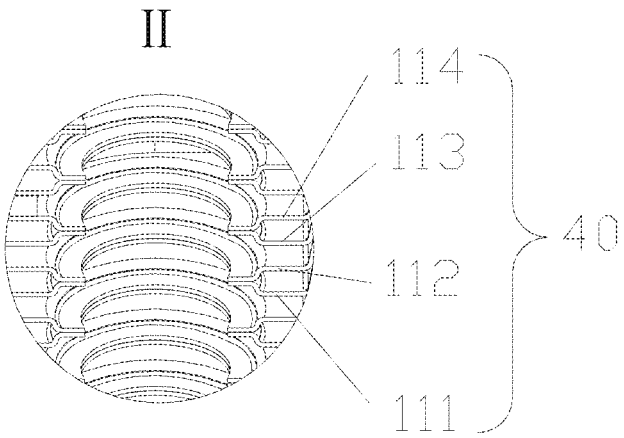
FIG. 5 is a view, partially enlarged at position II, of the sectional view of the heat exchanger of FIG. 3.

In order to more clearly show the structure that the third plate 111, the first plate 112, the second plate 113 and the fourth plate 114 are stacked together in a specific situation, FIG. 4 and FIG. 5 show partially enlarged views of FIG. 3.

As shown in FIGS. 6 to 9, each of the third plate 111, the first plate 112, the second plate 113 and the fourth plate 114 is an approximately rectangular structure, and each of the third plate 111, the first plate 112, the second plate 113 and the fourth plate includes a plate face and a flange.

A direction from the third plate 111 to the first plate 112 is defined as a convex direction, and a direction opposite to the convex direction is a concave direction. For example, if the first plate 112 is located right above the third plate 111, the direction from the third plate 111 to the first plate 112 is upward, and the upward direction is the convex direction, and the downward direction is the concave direction.

The flange may be formed by bending in the convex direction or in the concave direction. When the adjacent plates are stacked together, part of a flange of a plate is closely abutted with part of a flange of the adjacent plate. The plate face may be a flat surface, or a surface with a corrugated shape, protruding dots, recessed dots, or other forms of surfaces.

The third plate 111 includes a first corner portion 1111, a second corner portion 1112, a third corner portion 1113, and a fourth corner portion 1114. The first plate 112 includes a first corner portion 1121, a second corner portion 1122, a third corner portion 1123, and a fourth corner portion 1124. The second plate 113 includes a first corner portion 1131, a second corner portion 1132, a third corner portion 1133, and a fourth corner portion 1134. The fourth plate 114 includes a first corner portion 1141, a second corner portion 1142, a third corner portion 1143, and a fourth corner portion 1144.

Figure 10:
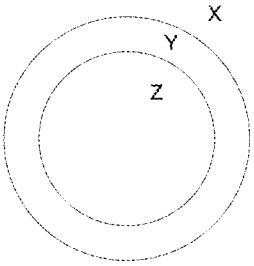
FIG. 10 is a schematic view of a loop according to the present application.

FIG. 10 shows a view of a loop. The loop includes an outer ring and an inner ring. The outer ring and the inner ring divide the space into three regions, X, Y, and Z. The region X is a region outside the outer ring, which is referred to as an outside of the outer ring; the region Y is an ring region; and the region Z is an region inside the inner ring, which is referred to as an inside of the inner ring. It should be noted that, the inner ring and the outer ring may not be circular-shaped and may be other closed shapes.

Figure 6:
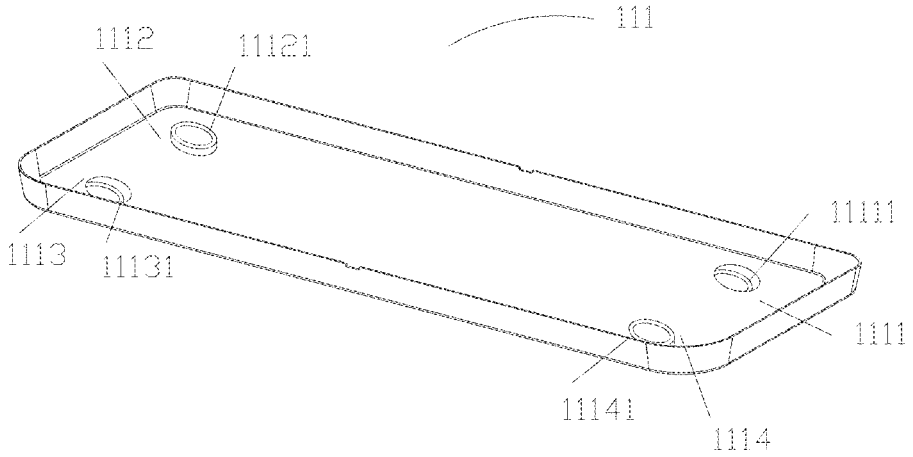
FIG. 6 is a schematic structural view of a third plate in FIG. 1.

As shown in FIG. 6, the first corner portion 1111 of the third plate 111 includes a loop 11111, the second corner portion 1112 of the third plate 111 includes a loop 11121, the third corner portion 1113 of the third plate 111 includes a loop 11131, and the fourth corner portion 1114 of the third plate 111 includes a loop 11141. A hole is provided in an inside of an inner ring of the loop 11111 of the first corner portion of the third plate 111; and a hole is provided in an inside of an inner ring of the loop 11131 of the third corner portion 1113 of the third plate 111.

Figure 7:
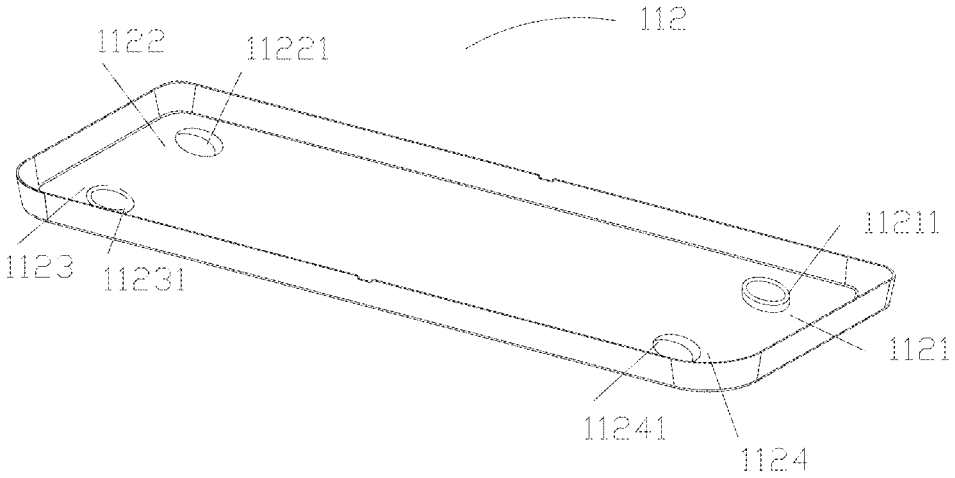
FIG. 7 is a schematic structural view of a first plate in FIG. 1.

As shown in FIG. 7, the first corner portion 1121 of the first plate 112 includes a loop 11211, the second corner portion 1122 of the first plate 112 includes a loop 11221, the third corner portion 1123 of the first plate 112 includes a loop 11231, and the fourth corner portion 1124 of the first plate 112 includes a loop 11241. It should be noted that, in FIG. 7, the loop 11231 of the third corner portion 1123 of the first plate 112 is flush with a plate face thereof, so the loop

11231 of the third corner portion of the first plate 112 is represented by broken lines in FIG. 7, and the following is the same.

A hole is provided in an inside of an inner ring of the loop 11211 of the first corner portion of the first plate 112; no hole is provided in an inside of an inner ring of the loop 11231 of the third corner portion of the first plate 112. No hole is provided in an inside of an inner ring of the loop 11121 of the second corner portion of the third plate 111 and/or no hole is provided in an inside of an inner ring of the loop 11221 of the second corner portion of the first plate 112. The loop 11111 of the first corner portion of the third plate 111 is not in contact with the loop 11211 of the first corner portion of the first plate 112; the loop 11121 of the second corner portion of the third plate 111 is in contact with and welded to the loop 11221 of the second corner portion of the first plate 112; the loop 11131 of the third corner portion of the third plate 111 is not in contact with the loop 11231 of the third corner portion of the first plate 112; the loop 11141 of the fourth corner portion of the third plate 111 is in contact with and welded to the loop 11441 of the fourth corner portion of the first plate 112. In this case, the first blocking portion is located at the third corner portion of the first plate.

Figure 8:
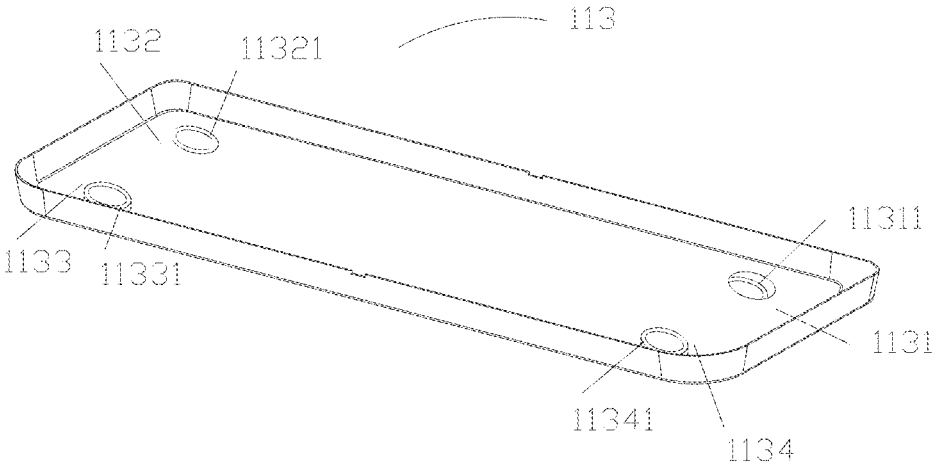
FIG. 8 is a schematic structural view of a second plate in FIG. 1.

As shown in FIG. 8, the first corner portion 1131 of the second plate 113 includes a loop 11311, the second corner portion 1132 of the second plate 113 includes a loop 11321, the third corner portion 1133 of the second plate 113 includes a loop 11331, and the fourth corner portion 1134 of the second plate 113 includes a loop 11341. A hole is provided in an inside of an inner ring of the loop 11311 of the first corner portion of the second plate 113; a hole is provided in an inside of an inner ring of the loop 11331 of the third corner portion of the second plate 113; a hole is provided in an inside of an inner ring of the loop 11341 of the fourth corner portion of the second plate 113. No hole is provided in an inside of an inner ring of the loop 11321 of the second corner portion of the second plate 113. The loop 11211 of the first corner portion of the first plate 112 is in contact with and welded to the loop 11311 of the first corner portion of the second plate 113; the loop 11221 of the second corner portion of the first plate 112 may be not in contact with, or in contact with and welded to, the loop 11321 of the second corner portion of the second plate 113; the loop 11231 of the third corner portion of the first plate 112 is not in contact with the loop 11331 of the third corner portion of the second plate 113; and the loop 11241 of the fourth corner portion of the first plate 112 is not in contact with the loop 11341 of the fourth corner portion of the second plate 113. The second blocking portion is located at the second corner portion of the second plate.

Figure 9:
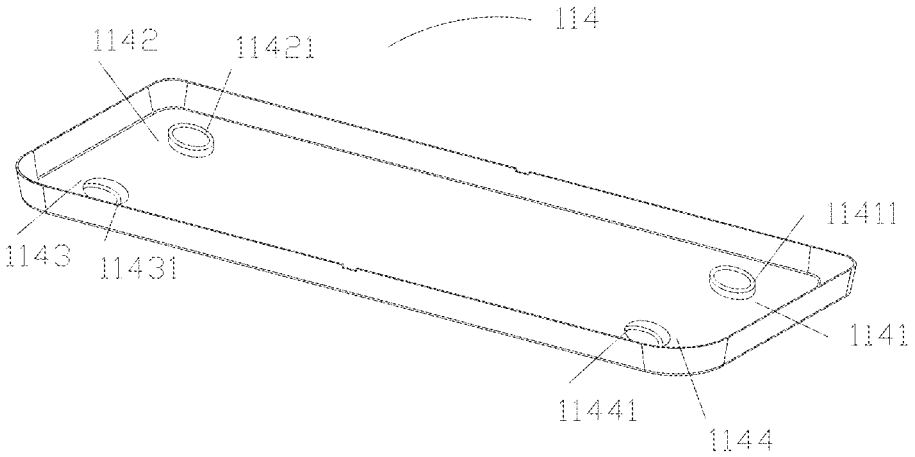
FIG. 9 is a schematic structural view of a fourth plate in FIG. 1.

As shown in FIG. 9, the first corner portion 1141 of the fourth plate 114 includes a loop 11411, the second corner portion 1142 of the fourth plate 114 includes a loop 11421, the third corner portion 1143 of the fourth plate 114 includes a loop 11431, and the fourth corner portion 1144 of the fourth plate 114 includes a loop 11441. A hole is provided in an inside of an inner ring of the loop 11411 of the first corner portion of the fourth plate 114; a hole is provided in an inside of an inner ring of the loop 11421 of the second corner portion of the fourth plate 114; a hole is provided in an inside of an inner ring of the loop 11431 of the third corner portion of the fourth plate 114; a hole is provided in an inside of an inner ring of the loop 11441 of the fourth corner portion of the fourth plate 114. The loop 11311 of the first corner portion of the second plate 113 is not in contact with the loop 11411 of the first corner portion of the fourth plate 114; the loop 11321 of the second corner portion of the second plate 113 is not in contact with the loop 11421 of the second corner portion of the fourth plate 114; the loop 11331 of the third corner portion of the second plate 113 is in contact with and welded to the loop 11431 of the third corner portion of the fourth plate 114; and the loop 11331 of the fourth corner portion of the second plate 113 is in contact with and welded to the loop 11441 of the fourth corner portion of the fourth plate 114.

Various specific embodiments of the contact welding between the loops of the adjacent plates in the heat exchanger core 11 are described as follows. The case that the loop of the fourth corner portion 1134 of the second plate 113 and the loop of the fourth corner portion 1144 of the fourth plate 114 are in contact with and welded to each other will be described as an example.

(First Embodiment of Contact Welding)

Figure 11:
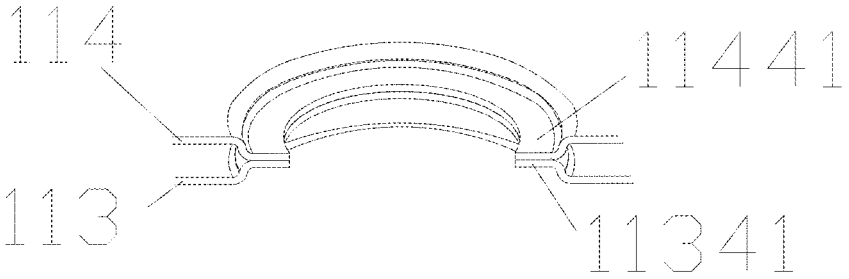
FIG. 11 is a specific embodiment of contacted welding according to the present application.

As shown in FIG. 11, the fourth corner portion 1134 of the second plate 113 includes a boss, and the loop 11341 is located at the boss of the fourth corner portion 1134 of the second plate 113; the fourth corner portion 1144 of the fourth plate 114 includes a recess, and the loop 11441 is located at the recess of the fourth corner portion 1144 of the fourth plate 114; the loop 11341 of the fourth corner portion of the second plate 113 is in contact with and welded to the loop 11441 of the fourth corner portion of the fourth plate 114.

(Second Embodiment of Contact Welding)

Figure 12:
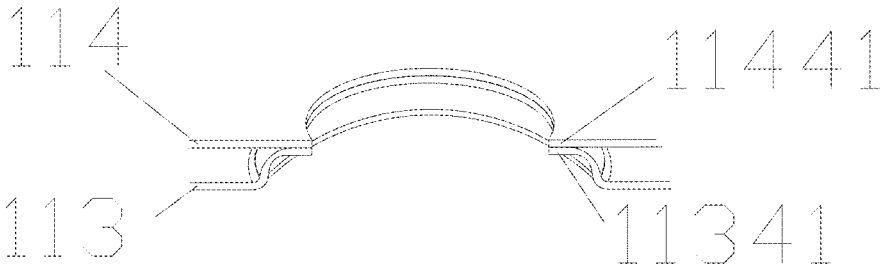
FIG. 12 is another specific embodiment of contacted welding according to the present application.

As shown in FIG. 12, the fourth corner portion 1134 of the second plate 113 includes a boss, and the loop 11341 is located at the boss of the fourth corner portion 1134 of the second plate 113; the loop 11441 of the fourth corner portion 1144 of the fourth plate 114 is flush with a plate face thereof; the loop 11341 of the fourth corner portion of the second plate 113 is in contact with and welded to the loop 11441 of the fourth corner portion of the fourth plate 114.

(Third Embodiment of Contact Welding)

Figure 13:
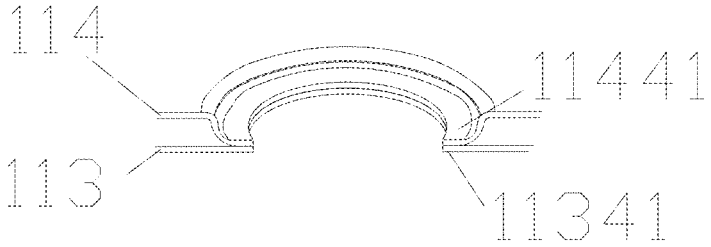
FIG. 13 is still another specific embodiment of contacted welding according to the present application.

As shown in FIG. 13, the loop 11341 of the fourth corner portion 1134 of the second plate 113 is flush with a plate face thereof; the fourth corner portion 1144 of the fourth plate 114 includes a recess, and the loop 11441 is located at the recess of the fourth corner portion 1144 of the second plate 113; the loop 11341 of the fourth corner portion of the second plate 113 is in contact with and welded to the loop 11441 of the fourth corner portion of fourth plate 114.

(Fourth Embodiment of Contact Welding)

Figure 14:
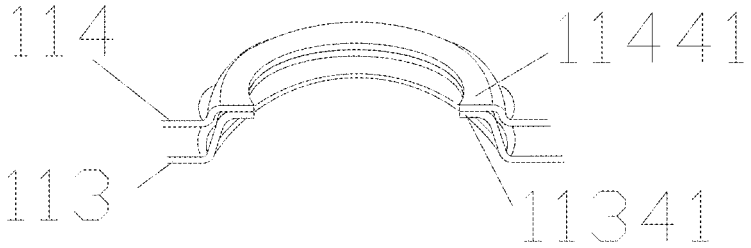
FIG. 14 is yet another specific embodiment of contacted welding according to the present application.

As shown in FIG. 14, the fourth corner portion 1134 of the second plate 113 includes a boss, and the loop 11341 is located at the boss of the fourth corner portion 1134 of the second plate 113; the fourth corner portion 1144 of the fourth plate 114 includes a short boss, and the loop 11441 is located at the short boss of the fourth corner portion 1144 of the fourth plate 114; the loop 11341 of the fourth corner portion of the second plate 113 is in contact with and welded to the loop 11441 of the fourth corner portion of the fourth plate 114. It should be noted that the short boss has a height smaller than that of the boss, so it is referred to as the short boss, which is only for the convenience of illustration, and the following is the same.

(Fifth Embodiment of Contact Welding)

Figure 15:
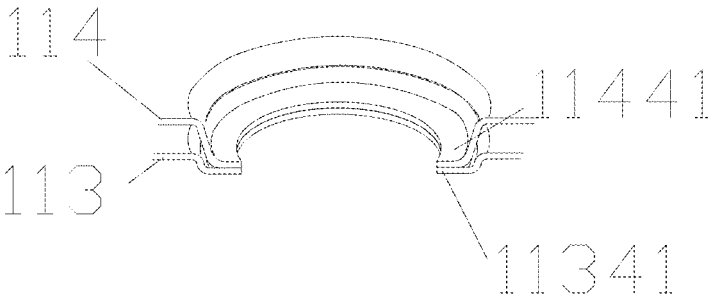
FIG. 15 is still yet another specific embodiment of contact welding according to the present application.

As shown in FIG. 15, the fourth corner portion 1134 of the second plate 113 includes a short recess, and the loop 11341 is located at the short recess of the fourth corner portion 1134 of the second plate 113; the fourth corner portion 1144 of the fourth plate 114 includes a recess, and the loop 11441 is located at the recess of the fourth corner portion 1144 of the fourth plate 114; the loop 11341 of the fourth corner portion of the second plate 113 is in contact with and welded to the loop 11441 of the fourth corner portion of the fourth plate 114. It should be noted that the short recess has a height smaller than that of the recess, so it is referred to as the short recess, which is only for the convenience of illustration, and the following is the same.

Various embodiments that the loops of the adjacent plates in the heat exchanger core 11 are not in contact with each other are as follows. The case that the loop 11111 of the first corner portion 1111 of the third plate 111 and the loop 11211 of the first corner portion 1121 of the first plate 112 are not in contact with each other will be described as an example.

(First Embodiment of Non-Contact)

Figure 16:
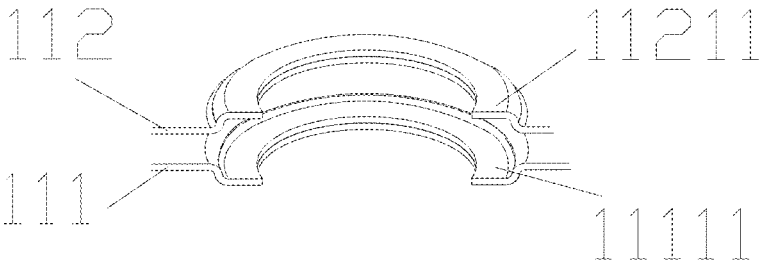
FIG. 16 is a specific embodiment of non-contact according to the present application.

As shown in FIG. 16, the first corner portion 1111 of the third plate 111 includes a recess, and the loop 11111 is located at the recess of the first corner portion 1111 of the third plate 111; the first corner portion 1121 of the first plate 112 includes a boss, and the loop 11211 is located at the boss of the first corner portion 1121 of the first plate 112; the loop 11111 of the first corner portion of the third plate 111 is not in contact with the loop 11211 of the first corner portion of the first plate 112.

(Second Embodiment of Non-Contact)

Figure 17:
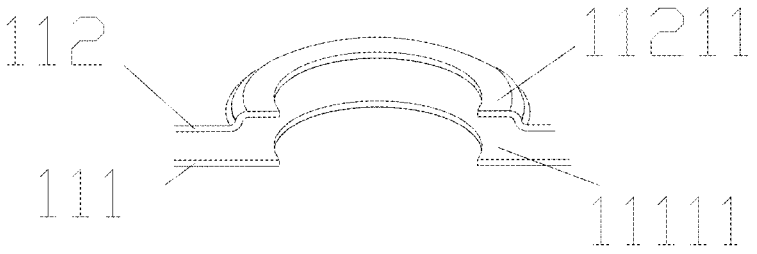
FIG. 17 is another specific embodiment of non-contact according to the present application.

As shown in FIG. 17, the loop 11111 of the first corner portion 1111 of the third plate 111 is flush with a plate face thereof; the first corner portion 1121 of the first plate 112 includes a boss, and the loop 11211 is located at the boss of the first corner portion 1121 of the first plate 112; the loop 11111 of the first corner portion of the third plate 111 is not in contact with the loop 11211 of the first corner portion of the first plate 112.

(Third Embodiment of Non-Contact)

Figure 18:
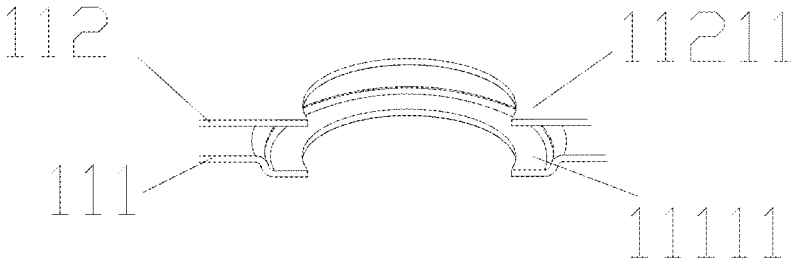
FIG. 18 is still another specific embodiment of non-contact according to the present application.

As shown in FIG. 18, the first corner portion 1111 of the third plate 111 includes a recess, and the loop 11111 is located at the recess of the first corner portion 1111 of the third plate 111; the loop 11211 of the first corner portion 1121 of the first plate 112 is flush with a plate face thereof; the loop 11111 of the first corner portion of the third plate 111 is not in contact with the loop 11211 of the first corner portion of the first plate 112.

(Fourth Embodiment of Non-Contact)

Figure 19:
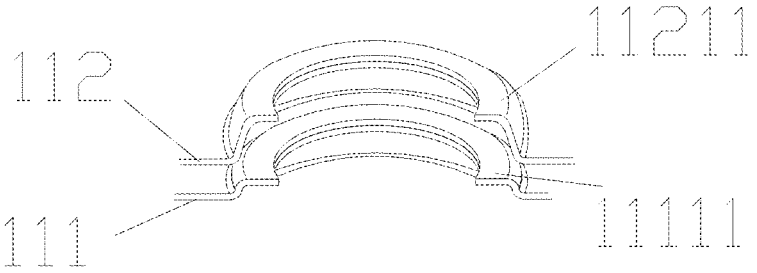
FIG. 19 is yet another specific embodiment of non-contact according to the present application.

As shown in FIG. 19, the first corner portion 1111 of the third plate 111 includes a boss (in particular, the boss here may be a short boss), and the loop 11111 is located at the boss of the first corner portion 1111 of the third plate 111; the first corner portion 1121 of the first plate 112 includes a boss, and the loop 11211 is located at the boss of the first corner portion 1121 of the first plate 112; the loop 11111 of the first corner portion of the third plate 111 is not in contact with the loop 11211 of the first corner portion of the first plate 112.

(Fifth Embodiment of Non-Contact)

Figure 20:
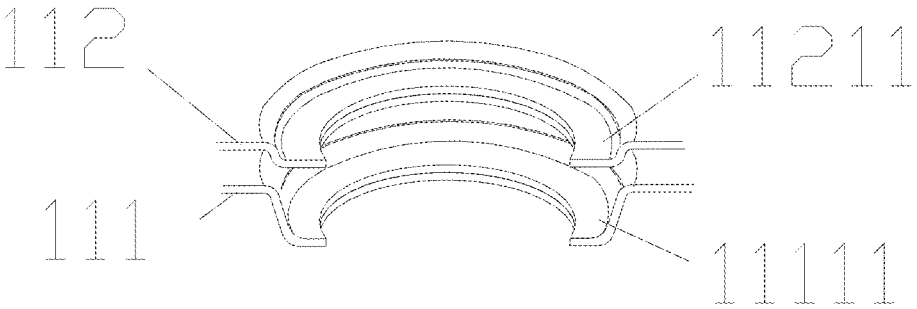
FIG. 20 is still yet another specific embodiment of non-contact according to the present application.

As shown in FIG. 20, the first corner portion 1111 of the third plate 111 includes a recess (in particular, the recess here may be a short recess), and the loop 11111 is located at the recess of the first corner portion 1111 of the third plate 111; the first corner portion 1121 of the first plate 112 includes a short recess, and the loop 11211 is located at the short recess of the first corner portion 1121 of the first plate 112; the loop 11111 of the first corner portion of the third plate 111 is not in contact with the loop 11211 of the first corner portion of the first plate 112.

The specific structure of one embodiment of the third plate 111, the first plate 112, the second plate 113, and the fourth plate 114 will be described in detail below.

As shown in FIG. 6, the first corner portion 1111 of the third plate 111 includes a recess, and the loop 11111 of the first corner portion of the third plate 111 is located at the recess of the first corner portion 1111 of the third plate 111; the second corner portion 1112 of the third plate 111 includes a boss, and the loop 11121 of the second corner portion of the third plate 111 is located at the boss of the second corner portion 1112 of the third plate 111; the third corner portion 1113 of the third plate 111 includes a recess, and the loop 11131 of the third corner portion of the third plate 111 is located at the recess of the third corner portion 1113 of the third plate 111; the fourth corner portion 1114 of the third plate 111 includes a boss, and the loop 11141 of the fourth corner portion of the third plate 111 is located at the boss of the fourth corner portion 1114 of the third plate 111.

A hole is provided in an inside of an inner ring of the loop 11111 of the first corner portion of the third plate 111; a hole is provided in an inside of an inner ring of the loop 11131 of the third corner portion 1113 of the third plate 111.

As shown in FIG. 7, the first corner portion 1121 of the first plate 112 includes a boss, and the loop 11211 of the first corner portion of the first plate 112 is located at the boss of the first corner portion 1121 of the first plate 112; the second corner portion 1122 of the first plate 112 includes a recess, and the loop 11221 of the second corner portion of the first plate 112 is located at the recess of the second corner portion 1122 of the first plate 112; the fourth corner portion 1124 of the first plate 112 includes a recess, and the loop 11241 of the fourth corner portion of the first plate 112 is located at the recess of the second corner portion 1124 of the first plate 112.

The third corner portion 1123 of the first plate 112 may have three situations: 1. the third corner portion 1123 of the first plate 112 may include a boss, and the loop 11231 of the third corner portion of the first plate 112 is located at the boss of the third corner portion 1123 of the first plate 112; 2. the third corner portion 1123 of the first plate 112 may include a recess, and the loop 11231 of the third corner portion of the first plate 112 is located at the recess of the third corner portion 1123 of the first plate 112; 3. the loop 11231 of the third corner portion of the first plate 112 is flush with a plate face of the first plate 112.

A hole is provided in an inside of an inner ring of the loop 11211 of the first corner portion of the first plate 112; no hole is provided in an inside of an inner ring of the loop 11231 of the third corner portion of the first plate 112. No hole is provided in an inside of an inner ring of the loop 11121 of the second corner portion of the third plate 111 and/or no hole is provided in an inside of an inner ring of the loop 11221 of the second corner portion of the first plate 112.

As shown in FIG. 8, the first corner portion 1131 of the second plate 113 includes a recess, and the loop 11311 of the first corner portion of the second plate 113 is located at the recess of the first corner portion 1131 of the second plate 113; the third corner portion 1133 of the second plate 113 includes a boss, and the loop 11331 of the third corner portion of the second plate 113 is located at the boss of the third corner portion 1133 of the second plate 113; the fourth corner portion 1134 of the second plate 113 includes a boss, and the loop 11341 of the fourth corner portion of the second plate 113 is located at the boss of the fourth corner portion 1134 of the second plate 113. The second corner portion 1132 of the second plate 113 may have three situations: 1. the second corner portion 1132 of the second plate 113 may include a boss, and the loop 11321 of the second corner portion of the second plate 113 is located at the boss of the second corner portion 1132 of the second plate 113; 2. the second corner portion 1132 of the second plate 113 may include a recess, and the loop 11321 of the second corner portion of the second plate 113 is located at the recess of the second corner portion 1132 of the second plate 113; 3. the loop 11321 of the second corner portion of the second plate 113 is flush with a plate face of the second plate 113. A hole is provided in an inside of an inner ring of the loop 11311 of the first corner portion of the second plate 113; a hole is provided in an inside of an inner ring of the loop 11331 of the third corner portion of the second plate 113; a hole is provided in an inside of an inner ring of the loop 11341 of the fourth corner portion of the second plate 113, and no hole is provided in an inside of an inner ring of the loop 11321 of the second corner portion of the second plate 113.

As shown in FIG. 9, the first corner portion 1141 of the fourth plate 114 includes a boss, and the loop 11411 of the first corner portion of the fourth plate 114 is located at the boss of the first corner portion 1141 of the fourth plate 114; the second corner portion 1142 of the fourth plate 114 includes a boss, and the loop 11421 of the second corner portion of the fourth plate 114 is located at the boss of the second corner portion 1142 of the fourth plate 114; the third corner portion 1143 of the fourth plate 114 includes a recess, and the loop 11431 of the third corner portion of the fourth plate 114 is located at the recess of the third corner portion 1143 of the fourth plate 114; the fourth corner portion 1144 of the fourth plate 114 includes a recess, and the loop 11441 of the fourth corner portion of the fourth plate 114 is located at the recess of the fourth corner portion 1144 of the fourth plate 114. A hole is provided in an inside of an inner ring of the loop 11411 of the first corner portion of the fourth plate 114; a hole is provided in an inside of an inner ring of the loop 11421 of the second corner portion of the fourth plate 114; a hole is provided in an inside of an inner ring of the loop 11431 of the third corner portion of the fourth plate 114; a hole is provided in an inside of an inner ring of the loop 11441 of the fourth corner portion of the fourth plate 114. A hole may be provided in each of an inner side of an inner ring of the loop 11141 of the fourth corner portion of the third plate 111 and an inner side of an inner ring of the loop 11241 of the fourth corner portion of the first plate 112, or a hole is provided in one of the two inner sides of the inner rings of the loop 11141 and the loop 11241, or no hole is provided in the two inner sides of the inner rings of the loop 11141 and the loop 11241.

A fluid passage between the third plate 111 and the first plate 112 is in the form of diagonal flow, a fluid passage between the first plate 112 and the second plate 113 is in the form of unilateral flow, and a fluid passage between the second plate 113 and the fourth plate 114 is in the form of unilateral flow.

The plates between the third plate 111 and the first side plate 12 (which may include the third plate 111 and the first side plate 12) constitute a diagonal flow portion, and the plates between the fourth plate 114 and the second side plate 13 (which may include the fourth plate 114 and the second side plate 13) constitute a unilateral flow portion.

In a case that a hole is provided in the fourth corner portion 1124 of the first plate 112, and a hole is provided in the fourth corner portion 1134 of the second plate 113, the heat exchanger 10 is as shown in FIG. 1. The first perforated member 14 is arranged at a position of the first side plate 12 corresponding to the second corner portion 1112 of the third plate 111; the second perforated member 15 is arranged at a position of the first side plate 12 corresponding to the third corner portion 1113 of the third plate 111; the third perforated member 16 is arranged at a position of the second side plate 13 corresponding to the second corner portion 1142 of the fourth plate; and the fourth perforated member 17 is arranged at a position of the second side plate 13 corresponding to the third corner portion 1143 of the fourth plate. When the heat exchanger 10 is working, fluids flowing in the heat exchanger 10 include a first heat exchange medium and a second heat exchange medium. The first heat exchange medium and the second heat exchange medium may be the same substance with different temperatures, or may be different substances with different temperatures. In a situation, a flowing manner of the heat exchange mediums is that, the first heat exchange medium flows in via one of the first perforated member 14 and the fourth perforated member 17, and flows out via the other one of the first perforated member 14 and the fourth perforated member 17; the second heat exchange medium flows in via one of the second perforated member 15 and the third perforated member 16, and flows out via the other one of the second perforated member 15 and the third perforated member 16. Preferably, when it is not the case that the first heat exchange medium and the second heat exchange medium both flow in via the perforated members on the first side plate 12 or both flow out via the perforated members on the first side plate 12, the first heat exchange medium and the second heat exchange medium in the heat exchanger 10 always flow in opposite directions, which improves the heat exchange efficiency. FIG. 21 is a schematic view showing one situation of the flowing of the heat exchange mediums including the first heat exchange medium and the second heat exchange medium in the heat exchanger 10 shown in FIG. 1, where flow path of one of the heat exchange mediums is shown by broken lines, and the other one of the heat exchange mediums is shown by solid lines.

In a case that at least one of the fourth corner portion 1124 of the first plate 112 and the fourth corner portion 1134 of the second plate 113 is not provided with the hole, the heat exchanger 10 is as shown in FIG. 2. The fifth perforated member 18 is arranged at a position of the first side plate 12 corresponding to the fourth corner portion 1114 of the third plate 111, and the sixth perforated member 19 is arranged at a position of the second side plate 13 corresponding to the fourth corner portion 1144 of the fourth plate. When the heat exchanger 10 is working, fluids flowing in the heat exchanger 10 include a first heat exchange medium, a second heat exchange medium, and may even include a third heat exchange medium. In one situation, the first heat exchange medium, the second heat exchange medium, and the third heat exchange medium may be the same substance with different temperatures, or may be different substances with different temperatures. A flowing manner of the heat exchange medium in one situation is that, the first heat exchange medium flows in via one of the first perforated member 14 and the fifth perforated member 18, and flows out via the other one of the first perforated member 14 and the fifth perforated member 18; the third heat exchange medium flows in via one of the sixth perforated member 19 and the fourth perforated member 17, and flows out via the other one of the sixth perforated member 19 and the fourth perforated member 17; the second heat exchange medium flows in via one of the second perforated member 15 and the third perforated member 16, and flows out via the other one of the second perforated member 15 and the third perforated member 16. In another situation, the first heat exchange medium flows in via one of the first perforated member 14 and the fifth perforated member 18, and flows out via the other one of the first perforated member 14 and the fifth perforated member 18, and then flows in via one of the sixth perforated member 19 and the fourth perforated member 17, and flows out via the other one of the sixth perforated member 19 and the fourth perforated member 17; the second heat exchange medium flows in via one of the second perforated member 15 and the third perforated member 16, and flows out via the other one of the second perforated member 15 and the third perforated member 16. In a case that the heat exchange mediums participating in the heat exchange flow in opposite directions, a higher heat exchange coefficient can be obtained.

It should be noted that "contact" in "contact welding" refers to being joined together after welding. For example, the loop 11341 of the fourth corner portion of the second plate 113 is in contact with and welded to the loop 11441 of the fourth corner portion of the fourth plate, a solder or coating is placed between the loop 11341 of the fourth corner portion of the second plate 113 and the loop 11441 of the fourth corner portion of the fourth plate, the loop 11341 and the loop 11441 are joined to each other after welding, which is referred to contact welding in this case.

It should be noted that the contact welding may refer to welding adjacent plates which are stacked, or may refer to performing furnace welding after the plates of the entire heat exchanger 10 are stacked together.

The first plate includes a plate face, and at least part of the first blocking portion is formed on the plate face of the first plate. The second plate includes a plate face, and at least part of the second blocking portion is formed on the plate face of the second plate. The first blocking portion and the second blocking portion may be formed by the first plate and the second plate; the first blocking portion may be formed by the first plate and the third plate together, and the second blocking portion may be formed by the second plate and the fourth plate together; the first blocking portion and the second blocking portion may also be formed by parts of the first plate and the second plate and other parts of the heat exchanger together. Therefore, in this application, at least part of the first blocking portion is located on the first plate, and at least part of the second blocking portion is located on the first plate and/or the second plate. The first blocking portion and the first plate are not limited to be a single member, and the second blocking and the first plate and/or the second plate are not limited to be a single member.

Figure 25:
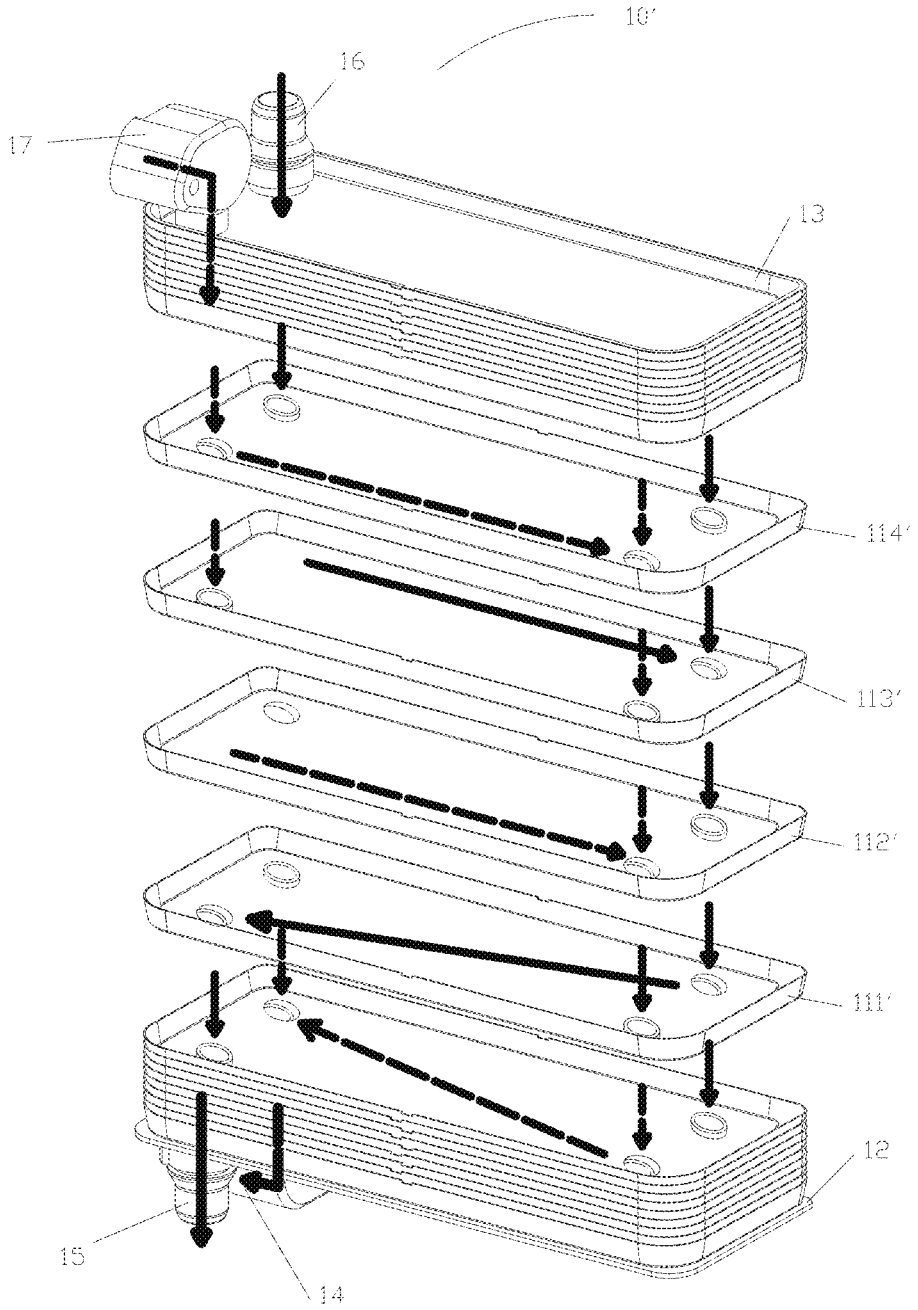
FIG. 25 is a schematic structural view of a heat exchanger according to another embodiment of the present application.

In another embodiment, referring to FIG. 25, which shows a schematic structural view of a heat exchanger 10'. The structure of the heat exchanger 10' is substantially similar to the structure of the heat exchanger 10. The heat exchanger 10' includes a first core portion, a second core portion and a third core portion, and the third core portion includes at least a first plate 112', a second plate 113', a third plate 111' and a fourth plate 114'.

Figure 26:
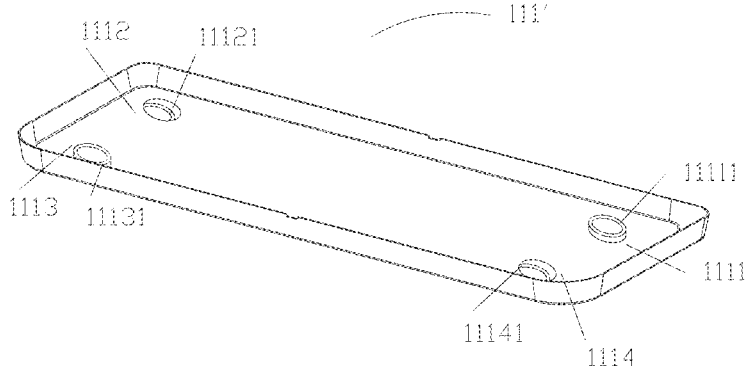
FIG. 26 is a schematic structural view of a third plate in FIG. 25.

Referring to FIG. 26, a hole is provided in an inside of an inner ring of a loop 11111 of a first corner portion of the third plate 111'; a hole is provided in an inside of an inner ring of a loop 11121 of a second corner portion 1112 of the third plate 111'; and a hole is provided in an inside of an inner ring of a loop 11141 of a fourth corner portion 1114 of the third plate 111'.

Figure 27:
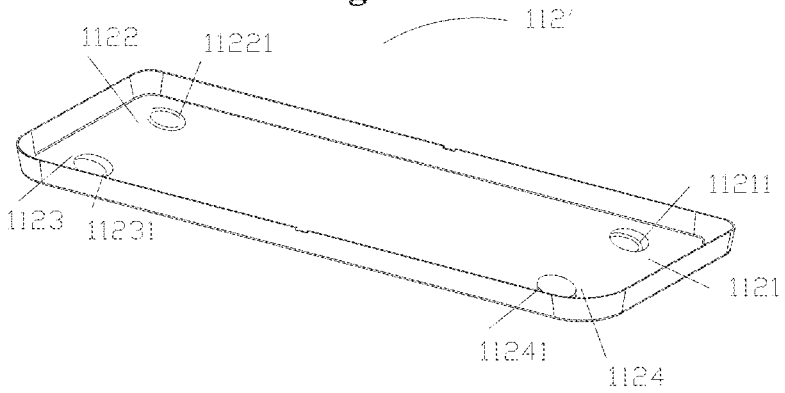
FIG. 27 is a schematic structural view of a first plate in FIG. 25.

Referring to FIG. 27, a first corner portion 1121 of the first plate 112' includes a loop 11211, a second corner portion 1122 of the first plate 112' includes a loop 11221, a third corner portion 1123 of the first plate 112' includes a loop 11231, and a fourth corner portion 1124 of the first plate 112' includes a loop 11241. A hole is provided in an inside of an inner ring of the loop 11211 of the first corner portion of the first plate 112'; no hole is provided in an inside of an inner ring of the loop 11221 of the second corner portion of the first plate 112'. No hole is provided in an inside of an inner ring of the loop 11131 of a third corner portion of the third plate 111' and/or no hole is provided in an inside of an inner ring of the loop 11231 of the third corner portion of the first plate 112'. The loop 11111 of the first corner portion of the third plate 111' is in contact with and welded to the loop 11211 of the first corner portion of the first plate 112'; the loop 11121 of the second corner portion of the third plate 111' is not in contact with the loop 11221 of the second corner portion of the first plate 112'; the loop 11131 of the third corner portion of the third plate 111' is in contact with and welded to the loop 11231 of the third corner portion of the first plate 112'; and the loop 11141 of the fourth corner portion of the third plate 111' is not in contact with the loop 11441 of the fourth corner portion of the first plate 112'. In this case, the first blocking portion is located at the second corner portion of the first plate 112'.

Figure 28:
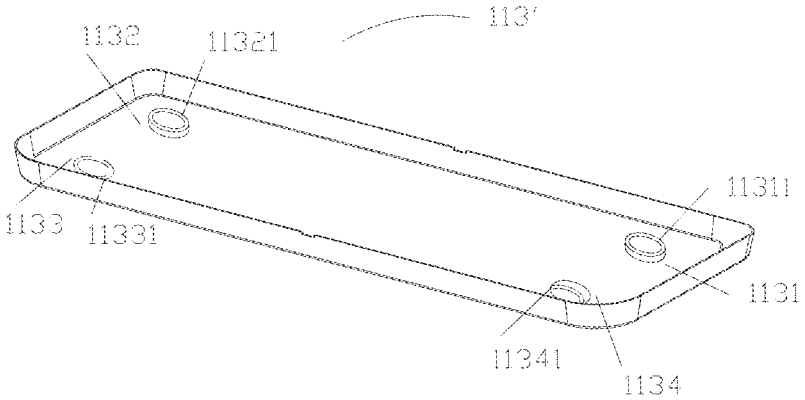
FIG. 28 is a schematic structural view of a second plate in FIG. 25.

Referring to FIG. 28, a first corner portion 1131 of the second plate 113' includes a loop 11311, a second corner portion 1132 of the second plate 113' includes a loop 11321, a third corner portion 1133 of the second plate 113' includes a loop 11331, and a fourth corner portion 1134 of the second plate 113' includes a loop 11341. A hole is provided in an inside of an inner ring of the loop 11311 of the first corner portion of the second plate 113'; a hole is provided in an inside of an inner ring of the loop 11321 of the second corner portion of the second plate; and no hole is provided in an inside of an inner ring of the loop 11331 of the third corner portion of the second plate 113'. No hole is provided in an inside of an inner ring of the loop 11241 of the fourth corner portion of the first plate and/or no hole is provided in an inside of an inner ring of the loop 11341 of the fourth corner portion of the second plate. The loop 11211 of the first corner portion of the first plate 112' is not in contact with the loop 11311 of the first corner portion of the second plate 113'; the loop 11221 of the second corner portion of the first plate 112' is not in contact with the loop 11321 of the second corner portion of the second plate 113'; the loop 11231 of the third corner portion of the first plate may be not in contact with or may be in contact with and welded to the loop 11331 of the third corner portion of the second plate; and the loop 11241 of the fourth corner portion of the first plate is in contact with and welded to the loop 11341 of the fourth corner portion of the second plate 113'. In this case, the second blocking portion is located at the third corner portion of the second plate.

Figure 29:
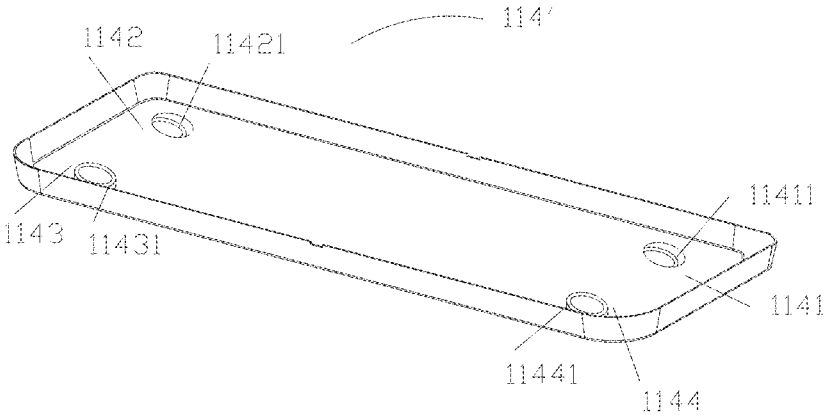
FIG. 29 is a schematic structural view of a fourth plate in FIG. 25.

Referring to FIG. 29, a first corner portion 1141 of the fourth plate 114' includes a loop 11411, a second corner portion 1142 of the fourth plate 114' includes a loop 11421, a third corner portion 1143 of the fourth plate 114' includes a loop 11431, and a fourth corner portion 1144 of the fourth plate 114' includes a loop 11441. A hole is provided in an inside of an inner ring of the loop 11411 of the first corner portion of the fourth plate 114'; a hole is provided in an inside of an inner ring of the loop 11421 of the second corner portion of the fourth plate 114'; a hole is provided in an inside of an inner ring of the loop 11431 of the third corner portion of the fourth plate 114'; and a hole is provided in an inside of an inner ring of the loop 11441 of the fourth corner portion of the fourth plate 114'. The loop 11311 of the first corner portion of the second plate 113' is in contact with and welded to the loop 11411 of the first corner portion of the fourth plate 114'; the loop 11321 of the second corner portion of the second plate 113' is in contact with and welded to the loop 11421 of the second corner portion of the fourth plate 114'; the loop 11331 of the third corner portion of the second plate 113' is not in contact with the loop 11431 of the third corner portion of the fourth plate 114'; and the loop 11331 of the fourth corner portion of the second plate 113' is not in contact with the loop 11441 of the fourth corner portion of the fourth plate 114'.

Figure 30:
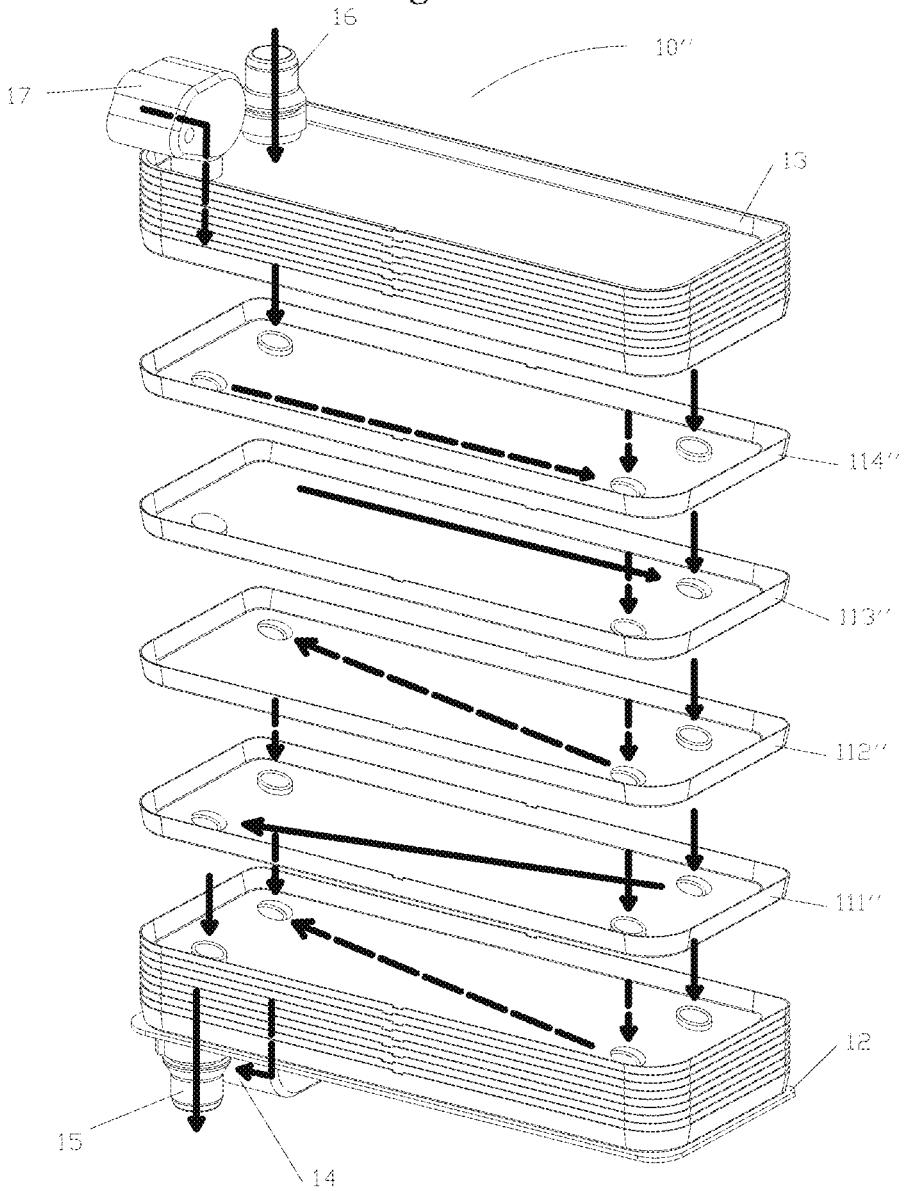
FIG. 30 is a schematic structural view of a heat exchanger according to still another embodiment of the present application.

In another embodiment, referring to FIG. 30, which shows a schematic structural view of a heat exchanger 10", and the structure of the heat exchanger 10" is substantially similar to the structure of the heat exchanger 10. The heat exchanger 10" includes a first core portion, a second core portion and a third core portion, and the third core portion includes at least a first plate 112", a second plate 113", a third plate 111" and a fourth plate 114".

Figure 31:
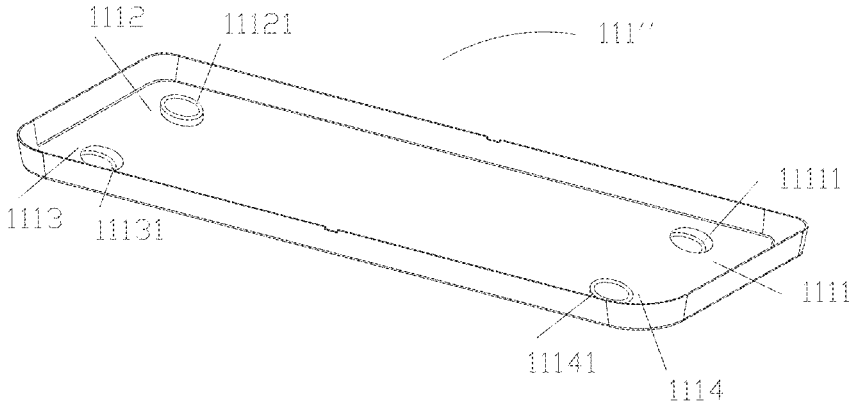
FIG. 31 is a schematic structural view of a third plate in FIG. 30.

Referring to FIG. 31, a first corner portion 1111 of the third plate 111" includes a loop 11111, a second corner portion 1112 of the third plate 111" includes a loop 11121, a third corner portion 1113 of the third plate 111" includes a loop 11131, and a fourth corner portion 1114 of the third plate 111" includes a loop 11141. A hole is provided in an inside of an inner ring of the loop 11111 of the first corner portion of the third plate 111"; a hole is provided in an inside of an inner ring of the loop 11121 of the second corner portion 1112 of the third plate 111"; a hole is provided in an inside of an inner ring of the loop 11131 of the third corner portion 1113 of the third plate 111"; and a hole is provided in an inside of an inner ring of the loop 11141 of the fourth corner portion 1114 of the third plate 111".

Figure 32:
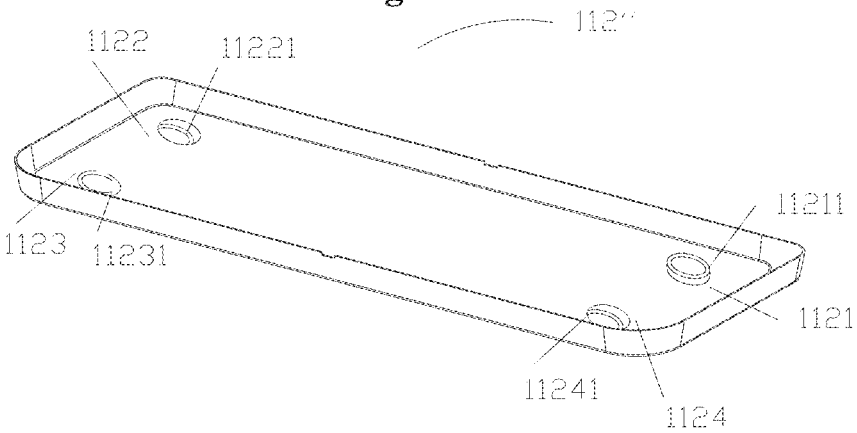
FIG. 32 is a schematic structural view of a first plate in FIG. 30.

Referring to FIG. 32, a first corner portion 1121 of the first plate 112" includes a loop 11211, a second corner portion 1122 of the first plate 112" includes a loop 11221, a third corner portion 1123 of the first plate 112" includes a loop 11231, and a fourth corner portion 1124 of the first plate 112" includes a loop 11241. A hole is provided in an inside of an inner ring of the loop 11211 of the first corner portion of the first plate 112"; a hole is provided in an inside of an inner ring of the loop 11221 of the second corner portion of the first plate 112"; no hole is provided in an inside of an inner ring of the loop 11231 of the third corner portion of the first plate 112"; and a hole is provided in an inside of an inner ring of the loop 11241 of the fourth corner portion of the first plate 112". The loop 11111 of the first corner portion of the third plate 111" is not in contact with the loop 11211 of the first corner portion of the first plate 112"; the loop 11121 of the second corner portion of the third plate 111" is in contact with and welded to the loop 11221 of the second corner portion of the first plate; the loop 11131 of the third corner portion of the third plate 111" is not in contact with the loop 11231 of the third corner portion of the first plate 112"; and the loop 11141 of the fourth corner portion of the third plate 111" is in contact with and welded to the loop 11441 of the fourth corner portion of the first plate 112". In this case, the first blocking portion is located at the third corner portion of the first plate.

Figure 33:
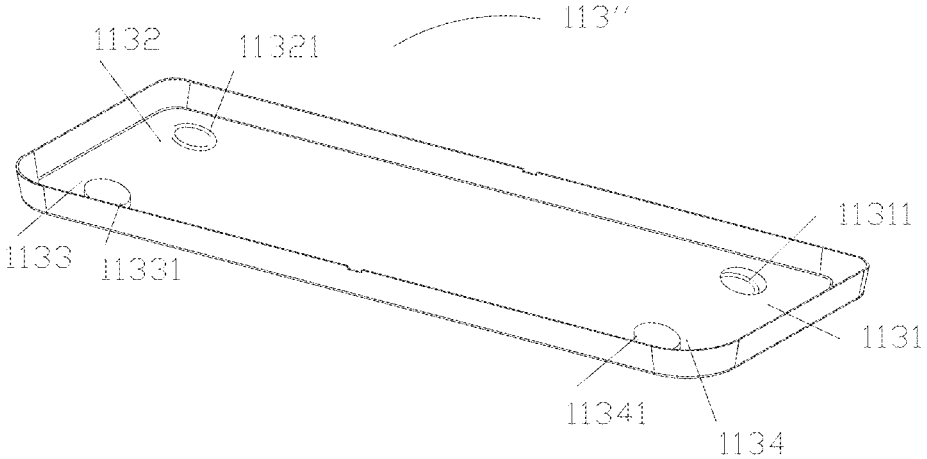
FIG. 33 is a schematic structural view of a second plate in FIG. 30.

Referring to FIG. 33, a first corner portion 1131 of the second plate 113" includes a loop 11311, a second corner portion 1132 of the second plate 113" includes a loop 11321, a third corner portion 1133 of the second plate 113" includes a loop 11331, and a fourth corner portion 1134 of the second plate 113" includes a loop 11341. A hole is provided in an inside of an inner ring of the loop 11311 of the first corner portion of the second plate 113"; and no hole is provided in an inside of an inner ring of the loop 11321 of the second corner portion of the second plate 113". The loop 11211 of the first corner portion of the first plate 112" is in contact with and welded to the loop 11311 of the first corner portion of the second plate 113"; the loop 11221 of the second corner portion of the first plate 112" is not in contact with the loop 11321 of the second corner portion of the second plate 113"; the loop 11231 of the third corner portion of the first plate 112" may be not in contact with or may be in contact with and welded to the loop 11331 of the third corner portion of the second plate 113"; and the loop 11241 of the fourth corner portion of the first plate 112" is not in contact with the loop 11341 of the fourth corner portion of the second plate 113". In this case, the second blocking portion is located at the second corner portion of the second plate.

Figure 34:
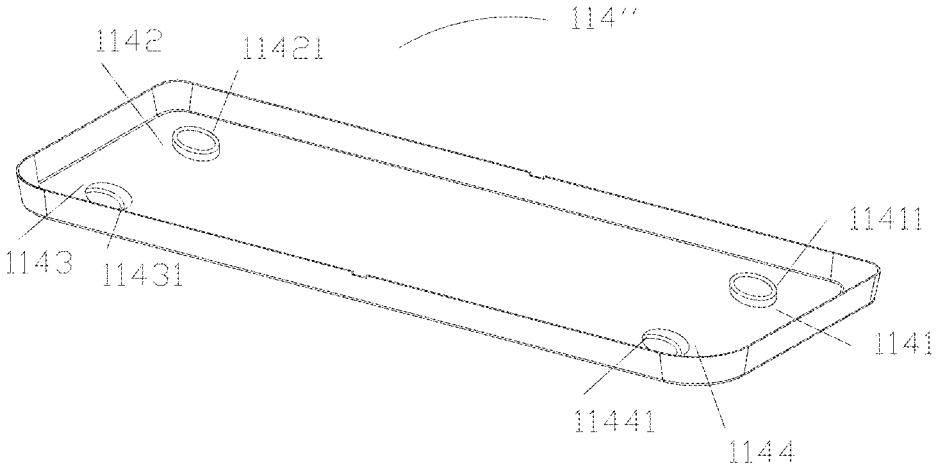
FIG. 34 is a schematic structural view of a fourth plate in FIG. 30.

Referring to FIG. 34, a first corner portion 1141 of the fourth plate 114" includes a loop 11411, a second corner portion 1142 of the fourth plate 114" includes a loop 11421, a third corner portion 1143 of the fourth plate 114" includes a loop 11431, and a fourth corner portion 1144 of the fourth plate 114" includes a loop 11441. A hole is provided in an inside of an inner ring of the loop 11411 of the first corner portion of the fourth plate 114"; and a hole is provided in an inside of an inner ring of the loop 11421 of the second corner portion of the fourth plate 114". No hole is provided in an inside of an inner ring of the loop 11331 of the third corner portion of the second plate 113" and/or no hole is provided in an inside of an inner ring of the loop 11421 of the third corner portion of the fourth plate 114". The loop 11311 of the first corner portion of the second plate 113" is not in contact with the loop 11411 of the first corner portion of the fourth plate 114"; the loop 11321 of the second corner portion of the second plate 113" is not in contact with the loop 11421 of the second corner portion of the fourth plate 114";

the loop 11331 of the third corner portion of the second plate 113" is in contact with and welded to the loop 11431 of the third corner portion of the fourth plate 114"; and the loop 11341 of the fourth corner portion of the second plate 113" is in contact with and welded to the loop 11441 of the fourth corner portion of the fourth plate 114".

Figure 35:
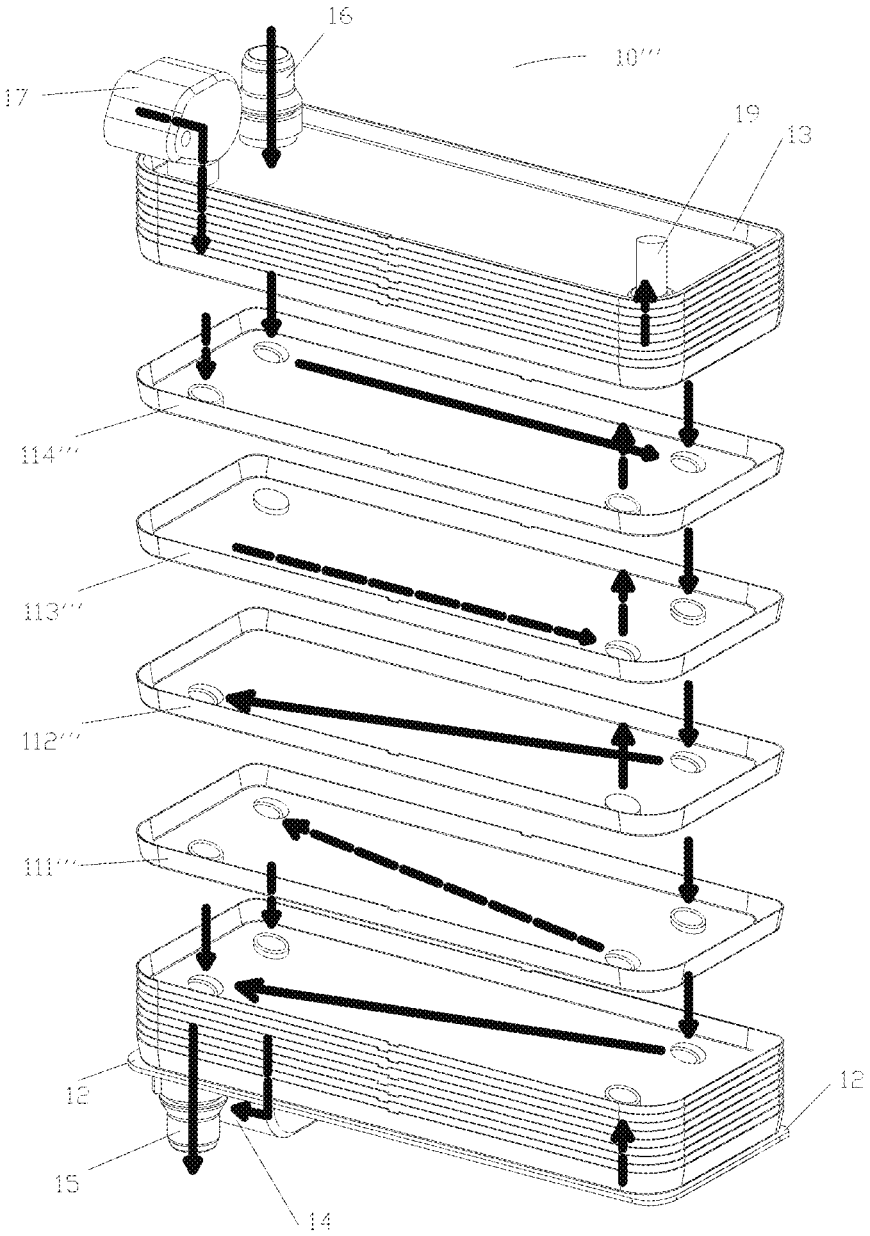
FIG. 35 is a schematic structural view of a heat exchanger according to yet another embodiment of the present application.

Referring to FIG. 35, which shows a schematic structural view of a heat exchanger 10'", and the structure of the heat exchanger 10'" is substantially similar to the structure of the heat exchanger 10. The heat exchanger 10'" includes a first core portion, a second core portion and a third core portion, and the third core portion includes at least a first plate 112'", a second plate 113'", a third plate 111'" and a fourth plate 114'".

Figure 36:
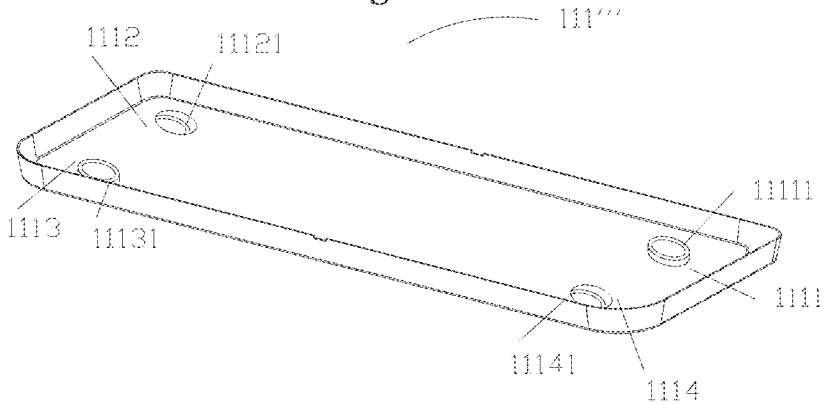
FIG. 36 is a schematic structural view of a third plate in FIG. 35.

As shown in FIG. 36, a first corner portion 1111 of the third plate 111'" includes a loop 11111, a second corner portion 1112 of the third plate 111'" includes a loop 11121, a third corner portion 1113 of the third plate 111'" includes a loop 11131, and a fourth corner portion 1114 of the third plate 111'" includes a loop 11141. A hole is provided in an inside of an inner ring of the loop 11111 of the first corner portion of the third plate 111'"; a hole is provided in an inside of an inner ring of the loop 11121 of the second corner portion 1112 of the third plate 111'"; a hole is provided in an inside of an inner ring of the loop 11131 of the third corner portion 1113 of the third plate 111'"; and a hole is provided in an inside of an inner ring of the loop 11141 of the fourth corner portion 1114 of the third plate 111'".

Figure 37:
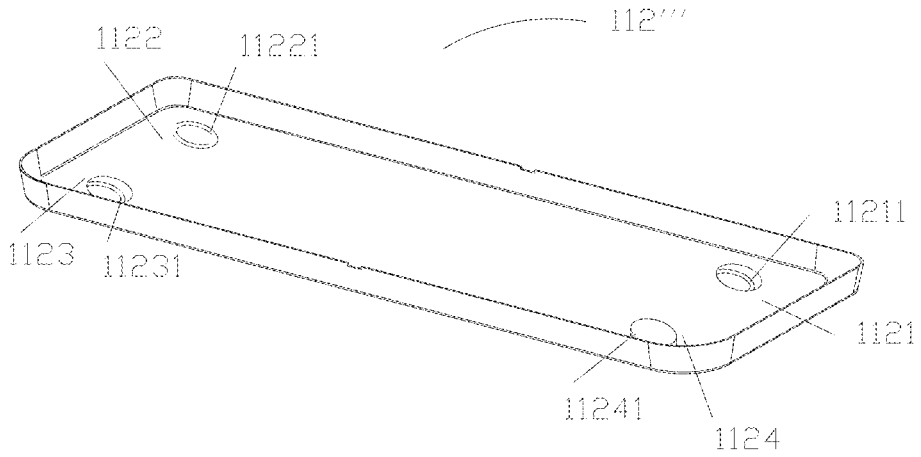
FIG. 37 is a schematic structural view of a first plate in FIG. 35.

As shown in FIG. 37, a first corner portion 1121 of the first plate 112'" includes a loop 11211, a second corner portion 1122 of the first plate 112'" includes a loop 11221, a third corner portion 1123 of the first plate 112'" includes a loop 11231, and a fourth corner portion 1124 of the first plate 112'" includes a loop 11241. A hole is provided in an inside of an inner ring of the loop 11211 of the first corner portion of the first plate 112'", no hole is provided in an inside of an inner ring of the loop 11221 of the second corner portion of the first plate 112'"; and a hole is provided in an inside of an inner ring of the loop 11131 of the third corner portion of the third plate 111'". The loop 11111 of the first corner portion of the third plate 111'" is in contact with and welded to the loop 11211 of the first corner portion of the first plate 112'"; the loop 11121 of the second corner portion of the third plate 111'" is not in contact with the loop 11221 of the second corner portion of the first plate 112'''; the loop 11131 of the third corner portion of the third plate 111''' is in contact with and welded to the loop 11231 of the third corner portion of the first plate 112'''; and the loop 11141 of the fourth corner portion of the third plate 111''' is not contact with the loop 11441 of the fourth corner portion of the first plate 112'''. In this case, the first blocking portion is located at the second corner portion of the first plate.

Figure 38:
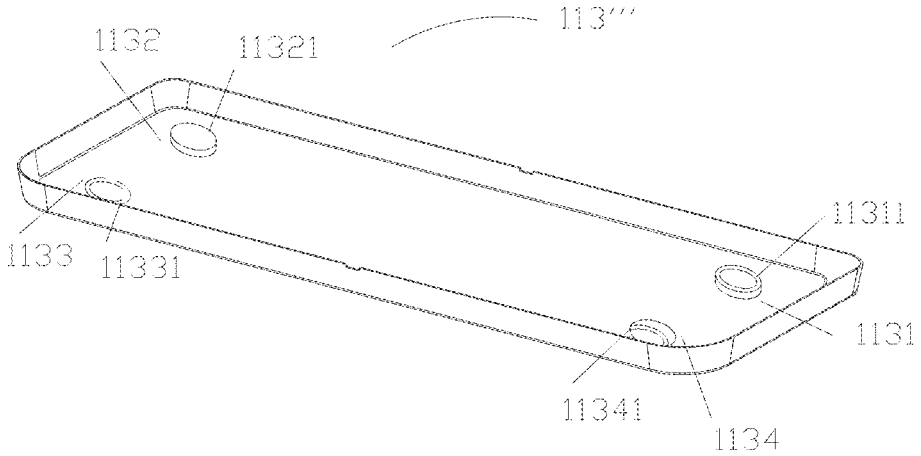
FIG. 38 is a schematic structural view of a second plate in FIG. 35.

As shown in FIG. 38, a first corner portion 1131 of the second plate 113''' includes a loop 11311, a second corner portion 1132 of the second plate 113''' includes a loop 11321, a third corner portion 1133 of the second plate 113''' includes a loop 11331, and a fourth corner portion 1134 of the second plate 113''' includes a loop 11341. A hole is provided in an inside of an inner ring of the loop 11311 of the first corner portion of the second plate 113'''; no hole is provided in an inside of an inner ring of the loop 11331 of the third corner portion of the second plate 113'''. No hole is provided in an inside of an inner ring of the loop 11241 of the fourth corner portion of the first plate 112''' and/or no hole is provided in an inside of an inner ring of the loop 11341 of the fourth corner portion of the second plate 113'''. The loop 11211 of the first corner portion of the first plate 112''' is not in contact with the loop 11311 of the first corner portion of the second plate 113''; the loop 11221 of the second corner portion of the first plate 112''' may be in contact with and welded to or may not be in contact with the loop 11321 of the second corner portion of the second plate 113'''; the loop 11231 of the third corner portion of the first plate 112''' is not in contact with the loop 11331 of the third corner portion of the second plate 113''; and the loop 11241 of the fourth corner portion of the first plate 112''' is in contact with and welded to the loop 11341 of the fourth corner portion of the second plate 113'''. In this case, the second blocking portion is located at the third corner portion of the second plate.

Figure 39:
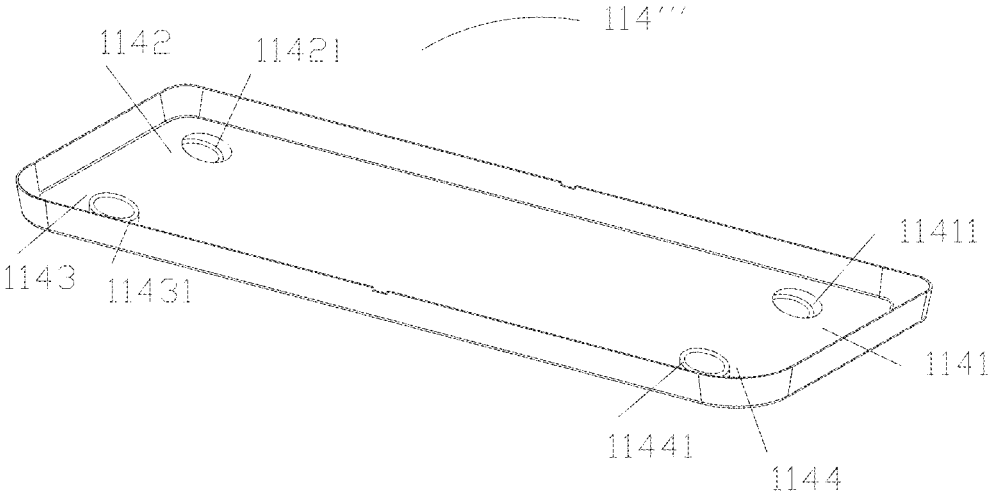
FIG. 39 is a schematic structural view of a fourth plate in FIG. 35.

As shown in FIG. 39, a first corner portion 1141 of the fourth plate 114''' includes a loop 11411, a second corner portion 1142 of the fourth plate 114''' includes a loop 11421, a third corner portion 1143 of the fourth plate 114''' includes a loop 11431, and a fourth corner portion 1144 of the fourth plate 114''' includes a loop 11441. A hole is provided in an inside of an inner ring of the loop 11411 of the first corner portion of the fourth plate 114'''; a hole is provided in an inside of an inner ring of the loop 11431 of the third corner portion of the fourth plate 114''; and a hole is provided in an inside of an inner ring of the loop 11441 of the fourth corner portion of the fourth plate 114''. A hole is provided in an inside of an inner ring of the loop 11321 of the second corner portion of the second plate 113''' and/or no hole is provided in an inside of an inner ring of the loop 11421 of the second corner portion of the fourth plate 114'''. The loop 11311 of the first corner portion of the second plate 113''' is in contact with and welded to the loop 11411 of the first corner portion of the fourth plate 114''; the loop 11321 of the second corner portion of the second plate 113''' is in contact with and welded to the loop 11421 of the second corner portion of the fourth plate 114'''; the loop 11331 of the third corner portion of the second plate 113''' is not in contact with the loop 11431 of the third corner portion of the fourth plate 114'''; and the loop 11331 of the fourth corner portion of the second plate 113''' is not in contact with the loop 11441 of the fourth corner portion of the fourth plate 114''.

With the above third core portion 40, the switching between the unilateral flow and the diagonal flow in the same heat exchanger may be realized. Each of the heat exchanger 10, the heat exchanger 10', the heat exchanger 10'', and the heat exchanger 10''' includes the third core portion 40, the third core portion 40, the second core portion 20 and the first core portion 30 are connected by stacking plates, therefore, a smaller space is occupied when the same heat exchange effect is achieved, that is, the space utilization rate is higher and the structure is more compact. Which means, in a case that the same space is occupied, the heat exchanger 10, 10', 10'', and 10''' have better heat exchange effects. For machinery including a refrigeration system, such as an automobile, in the process of miniaturization, requirements for the space of refrigeration components are high, and due to other reasons such as external pipelines, there are special requirements for positions of inlet and outlet of the heat exchanger. In this case, since the third core portion 40, the second core portion 20 and the first core portion 30 of each of the heat exchanger 10, 10', 10'', and 10''' are arranged by stacking the plates, the risk of leakage caused by multiple external pipes being connected with the first core portion and the second core portion respectively may be reduced.

It should be noted that fins and other components configured to enhance the heat exchange may be arranged between the plates in the heat exchanger core 11, to enhance the heat exchange performance of the heat exchanger 10, 10', 10'', and 10'''.

Figure 22:
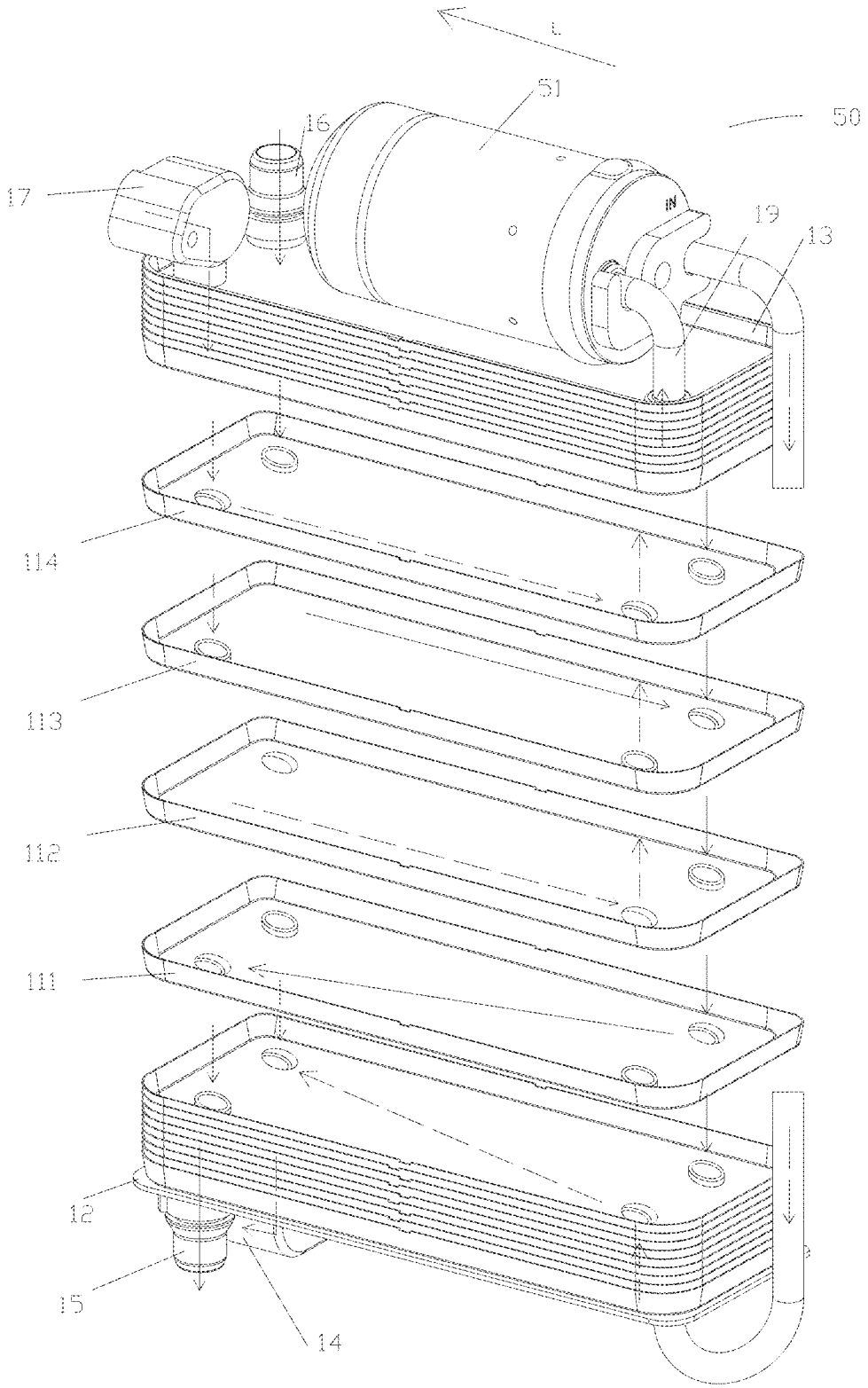
FIG. 22 is a schematic view of a flowing state of each of heat mediums in the heat exchanger according to an embodiment of the present application.
Figure 23:
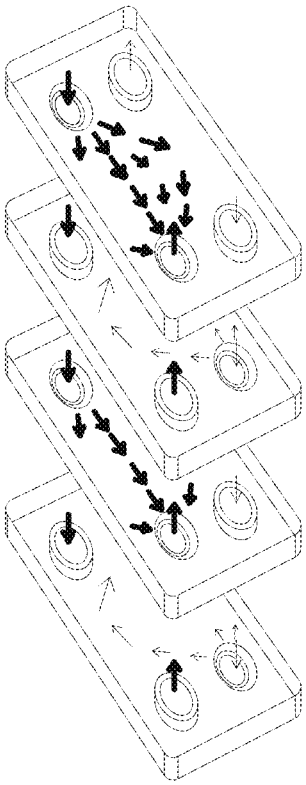
FIG. 23 is a schematic view showing the principle of a unilateral flow heat exchanger.
Figure 24:
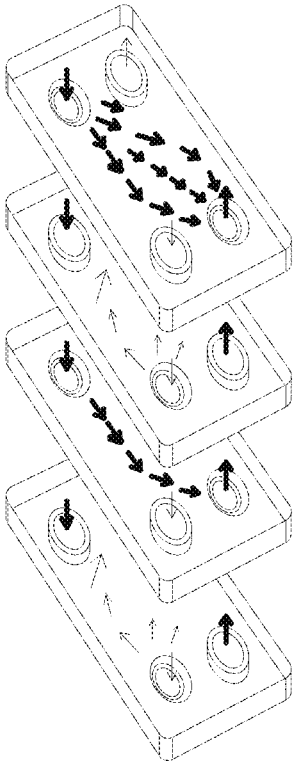
FIG. 24 is a schematic view showing the principle of a diagonal flow heat exchanger.

Referring to FIG. 22, which shows a heat exchange device 50, the heat exchange device 50 includes the heat exchanger 10 as shown in FIG. 2 and a liquid reservoir 51, and the liquid reservoir 51 is connected to the fifth perforated member 18 and the sixth perforated member 19 through pipelines. The liquid reservoir 51 is located at one side of the heat exchanger 10. For example, as shown in FIG. 22, the liquid reservoir 51 is located at a side that the second side plate 13 is located. The heat exchanger 10 has a length direction L, and the liquid reservoir 51 is placed along the length direction L. The heat exchanger 10 and the liquid reservoir 51 are integrated in the heat exchange device 50, and the heat exchanger 10 may act as a condenser and a supercooler in a refrigeration system. Such an integrated arrangement, compared with the arrangement that the liquid reservoir is arranged between the condenser and the supercooler, has the advantage of facilitating maintenance when the liquid reservoir fails. In addition, the liquid reservoir is located at one side of the heat exchanger, which makes the structure more compact.

FIG. 22 is a schematic view showing flowing of the heat exchange mediums including the first heat exchange medium and the second heat exchange medium, which is a flowing manner of the heat exchange mediums in the heat exchanger device 50 in one situation. A flow path of one of the heat exchange mediums is shown by broken lines in the figure, and a flow path of the other one of the heat exchange mediums is shown by solid lines in the figure. The first heat exchange medium flows into the heat exchanger 10 via the first perforated member 14, and flows out of the heat exchanger 10 via the fifth perforated member 18 and enters the liquid reservoir 51, and then flows into the heat exchanger 10 via the sixth perforated member 19, and flows out of the heat exchanger 10 via the fourth perforated member 17; the second heat exchange medium flows in via one of the second perforated member 15 and the third perforated member 16, and flows out via the other one of the second perforated member 15 and the third perforated member 16. In a case that the second heat exchange medium flows in via the third perforated member 16, the first heat exchange medium and the second heat exchange medium always flow reversely with respect to each other. In another embodiment, a flowing manner of the heat exchange mediums in another situation is that, the first heat exchange medium flows into the heat exchanger 10 via the fourth perforated member 17, and flows out of the heat exchanger 10 via the sixth perforated member 19 and enters the liquid reservoir 51, and then flows into the heat exchanger 10 via the fifth perforated member 18, and flows out of the heat exchanger 10 via the first perforated member 14; the second heat exchange medium flows in via one of the second perforated member 15 and the third perforated member 16, and flows out via the other one of the second perforated member 15 and the third perforated member 16. In a case that the second heat exchange medium flows in via the second perforated member 15, the first heat exchange medium and the second heat exchange medium always flow reversely with respect to each other. When the heat exchange mediums participating in the heat exchange flow reversely, a higher heat transfer coefficient can be obtained.

The above heat exchange device 50 is only an exemplary embodiment, and the heat exchanger 10, 10', 10" and 10'" may also be integrated with the liquid reservoir 51 similar to that shown in FIG. 22.

It should be noted that, expressions such as "first", "second", "third", "fourth", "fifth", and "sixth" are only for naming, and do not include any sequence limitation. The above embodiments are only used to illustrate the present application and not to limit the technical solutions of the present application. Although the present application is described in detail hereinabove with reference to the above embodiments, those of ordinary skill in the art should understand that modification or equivalent replacement may be made to the present application, and all technical solutions and improvements thereof that do not depart from the spirit and scope of the present application should be covered by the scope of the claims of the present application.

What is claimed is:

1. A heat exchanger, comprising a heat exchanger core, wherein the heat exchanger core comprises at least a first core portion, a second core portion and a third core portion, each of the first core portion, the second core portion and the third core portion is formed by stacked plates, and the third core portion is located between the first core portion and the second core portion;

the first core portion is configured to have a unilateral flow pattern, and the second core portion is configured to have a diagonal flow pattern;

the first core portion comprises a first hole passage, and the second core portion comprises a second hole passage; and the heat exchanger core comprises a first side portion and a second side portion, wherein the first side portion and the second side portion are arranged opposite to each other, the first hole passage and the second hole passage are arranged adjacent to the first side portion, and the first hole passage and the second hole passage are arranged in a misaligned manner in a stacking direction of the plates; wherein the third core portion comprises a first hole port and a second hole port, the first hole port and the second hole port are adjacent to the first side portion, the first hole port and the second hole port are arranged in a misaligned manner in the stacking direction of the plates, the second hole port is in communication with the first hole passage, and the first hole port is in communication with the second hole passage;

the third core portion comprises a fluid passage, an end port of the fluid passage is the first hole port, and another end port of the fluid passage is the second hole port; the fluid passage comprises at least a first path, a second path and a third path; and wherein the first path extends in a direction from the first side portion to the second side portion. and the first path is of the unilateral flow pattern; the second path extends in the stacking direction of the plates; and the third path extends in a direction from the second side portion to the first side portion, and the third path is of the diagonal flow pattern.

2. The heat exchanger according to claim 1, wherein the third core portion comprises at least a first blocking portion and a second blocking portion, the first blocking portion is located at a position corresponding to the second hole port, and the second blocking portion is located at a position corresponding to the first hole port; and the third core portion comprises at least a first plate and a second plate, and in the stacking direction of the plates, the first blocking portion blocks a flow passage in the first plate which is located at a position corresponding to the second hole port, and the second blocking portion blocks a flow passage in the second plate which is located at a position corresponding to the first hole port.

3. The heat exchanger according to claim 2, wherein the third core portion comprises a third plate, a fourth plate, a fifth plate and a sixth plate, the fourth plate and the fifth plate are stacked at a side where the second plate is located, and the third plate and the sixth plate are stacked at a side where the first plate is located; and wherein the first path is located between the fourth plate and the fifth plate, or the first path is located between the fourth plate and the second plate;

the second path is adjacent to the second side portion; and the third path is located between the first plate and the second plate, or the third path is located between the first plate and the third plate, or the third path is located between the third plate and the sixth plate.

4. The heat exchanger according to claim 3, wherein the fluid passage of the third core portion comprises at least the first hole passage, the second hole port, the first path, the second path, the third path, and the second hole passage; and wherein the first path is of the unilateral flow pattern, and the third path is of the diagonal flow pattern.

5. The heat exchanger according to claim 3, wherein each of the first plate and the second plate comprises a first corner portion, a second corner portion, a third corner portion, and a fourth corner portion;

a hole is provided in an inside of an inner ring of a loop of the first corner portion of the first plate, no hole is provided in an inside of an inner ring of a loop of the third corner portion of the first plate, and the first blocking portion is located at the third corner portion of the first plate; and no hole is provided in an inside of an inner ring of a loop of the second corner portion of the second plate and/or no hole is provided in an inside of an inner ring of a loop of the second corner portion of the first plate, and the second blocking portion is located at the second corner portion of the second plate.

6. The heat exchanger according to claim 3, wherein each of the first plate and the second plate comprises a first corner portion, a second corner portion, a third corner portion, and a fourth corner portion;

a hole is provided in an inside of an inner ring of a loop of the first corner portion of the first plate, no hole is provided in an inside of an inner ring of a loop of the second corner portion of the first plate, a hole is provided in an inside of an inner ring of a loop of the third corner portion of the first plate, no hole is provided in an inside of an inner ring of a loop of the fourth corner portion of the first plate, and the first blocking portion is located at the second corner portion of the first plate; and a hole is provided in an inside of an inner ring of a loop of the first corner portion of the second plate, a hole is provided in an inside of an inner ring of a loop of the second corner portion of the second plate, no hole is provided in an inside of an inner ring of a loop of the third corner portion of the second plate, and the second blocking portion is located at the third corner portion of the second plate.

7. The heat exchanger according to claim 3, wherein each of the first plate and the second plate comprises a first corner portion, a second corner portion, a third corner portion, and a fourth corner portion;

a hole is provided in an inside of an inner ring of a loop of the first corner portion of the first plate, a hole is provided in an inside of an inner ring of a loop of the second corner portion of the first plate, no hole is provided in an inside of an inner ring of a loop of the third corner portion of the first plate, a hole is provided in an inside of an inner ring of a loop of the fourth corner portion of the first plate, and the first blocking portion is located at the third corner portion of the first plate; and a hole is provided in an inside of an inner ring of a loop of the first corner portion of the second plate, no hole is provided in an inside of an inner ring of a loop of the second corner portion of the second plate, and the second blocking portion is located at the second corner portion of the second plate.

8. The heat exchanger according to claim 3, wherein each of the first plate and the second plate comprises a first corner portion, a second corner portion, a third corner portion, and a fourth corner portion;

a hole is provided in an inside of an inner ring of a loop of the first corner portion of the first plate, no hole is provided in an inside of an inner ring of a loop of the second corner portion of the first plate, and the first blocking portion is located at the second corner portion of the first plate; and a hole is provided in an inside of an inner ring of a loop of the first corner portion of the second plate, no hole is provided in an inside of an inner ring of a loop of the third corner portion of the second plate, and the second blocking portion is located at the third corner portion of the second plate.

9. A heat exchange device, comprising a liquid reservoir and the heat exchanger according to claim 3, wherein the heat exchanger comprises a first side plate and a second side plate, the heat exchanger core is located between the first side plate and the second side plate, the first core portion is a condensing portion, and the second core portion is a supercooling portion; and the liquid reservoir is located at a side of the first side plate or a side of the second side plate, an inlet of the liquid reservoir is in communication with an internal flow passage of the condensing portion, and an outlet of the liquid reservoir is in communication with an internal flow passage of the supercooling portion.

10. The heat exchanger according to claim 2, wherein the fluid passage of the third core portion comprises at least the first hole passage, the second hole port, the first path, the second path, the third path, and the second hole passage.

11. A heat exchange device, comprising a liquid reservoir and the heat exchanger according to claim 10, wherein the heat exchanger comprises a first side plate and a second side plate, the heat exchanger core is located between the first side plate and the second side plate, the first core portion is a condensing portion, and the second core portion is a supercooling portion; and the liquid reservoir is located at a side of the first side plate or a side of the second side plate, an inlet of the liquid reservoir is in communication with an internal flow passage of the condensing portion, and an outlet of the liquid reservoir is in communication with an internal flow passage of the supercooling portion.

12. The heat exchanger according to claim 2, wherein the first plate comprises a plate face, at least part of the first blocking portion is formed on the plate face of the first plate; the second plate comprises a plate face, and at least part of the second blocking portion is formed on the plate face of the second plate.

13. A heat exchange device, comprising a liquid reservoir and the heat exchanger according to claim 12, wherein the heat exchanger comprises a first side plate and a second side plate, the heat exchanger core is located between the first side plate and the second side plate, the first core portion is a condensing portion, and the second core portion is a supercooling portion; and the liquid reservoir is located at a side of the first side plate or a side of the second side plate, an inlet of the liquid reservoir is in communication with an internal flow passage of the condensing portion, and an outlet of the liquid reservoir is in communication with an internal flow passage of the supercooling portion.

14. The heat exchanger according to claim 2, wherein each of the first plate and the second plate comprises a first corner portion, a second corner portion, a third corner portion, and a fourth corner portion;

a hole is provided in an inside of an inner ring of a loop of the first corner portion of the first plate, no hole is provided in an inside of an inner ring of a loop of the third corner portion of the first plate, and the first blocking portion is located at the third corner portion of the first plate; and no hole is provided in an inside of an inner ring of a loop of the second corner portion of the second plate and/or no hole is provided in an inside of an inner ring of a loop of the second corner portion of the first plate, and the second blocking portion is located at the second corner portion of the second plate.

15. The heat exchanger according to claim 2, wherein each of the first plate and the second plate comprises a first corner portion, a second corner portion, a third corner portion, and a fourth corner portion;

a hole is provided in an inside of an inner ring of a loop of the first corner portion of the first plate, no hole is provided in an inside of an inner ring of a loop of the second corner portion of the first plate, a hole is provided in an inside of an inner ring of a loop of the third corner portion of the first plate, no hole is provided in an inside of an inner ring of a loop of the fourth corner portion of the first plate, and the first blocking portion is located at the second corner portion of the first plate; and a hole is provided in an inside of an inner ring of a loop of the first corner portion of the second plate, a hole is provided in an inside of an inner ring of a loop of the second corner portion of the second plate, no hole is provided in an inside of an inner ring of a loop of the third corner portion of the second plate, and the second blocking portion is located at the third corner portion of the second plate.

16. The heat exchanger according to claim 2, wherein each of the first plate and the second plate comprises a first corner portion, a second corner portion, a third corner portion, and a fourth corner portion;

a hole is provided in an inside of an inner ring of a loop of the first corner portion of the first plate, a hole is provided in an inside of an inner ring of a loop of the second corner portion of the first plate, no hole is provided in an inside of an inner ring of a loop of the third corner portion of the first plate, a hole is provided in an inside of an inner ring of a loop of the fourth corner portion of the first plate, and the first blocking portion is located at the third corner portion of the first plate; and a hole is provided in an inside of an inner ring of a loop of the first corner portion of the second plate, no hole is provided in an inside of an inner ring of a loop of the second corner portion of the second plate, and the second blocking portion is located at the second corner portion of the second plate.

17. The heat exchanger according to claim 2, wherein each of the first plate and the second plate comprises a first corner portion, a second corner portion, a third corner portion, and a fourth corner portion;

a hole is provided in an inside of an inner ring of a loop of the first corner portion of the first plate, no hole is provided in an inside of an inner ring of a loop of the second corner portion of the first plate, and the first blocking portion is located at the second corner portion of the first plate; and a hole is provided in an inside of an inner ring of a loop of the first corner portion of the second plate, no hole is provided in an inside of an inner ring of a loop of the third corner portion of the second plate, and the second blocking portion is located at the third corner portion of the second plate.

18. A heat exchange device, comprising a liquid reservoir and the heat exchanger according to claim 2, wherein the heat exchanger comprises a first side plate and a second side plate, the heat exchanger core is located between the first side plate and the second side plate, the first core portion is a condensing portion, and the second core portion is a supercooling portion; and the liquid reservoir is located at a side of the first side plate or a side of the second side plate, an inlet of the liquid reservoir is in communication with an internal flow passage of the condensing portion, and an outlet of the liquid reservoir is in communication with an internal flow passage of the supercooling portion.

19. A heat exchange device, comprising a liquid reservoir and the heat exchanger according to claim 1, wherein the heat exchanger comprises a first side plate and a second side plate, the heat exchanger core is located between the first side plate and the second side plate, the first core portion is a condensing portion, and the second core portion is a supercooling portion; and the liquid reservoir is located at a side of the first side plate or a side of the second side plate, an inlet of the liquid reservoir is in communication with an internal flow passage of the condensing portion, and an outlet of the liquid reservoir is in communication with an internal flow passage of the supercooling portion.

20. The heat exchange device according to claim 19, wherein the third core portion at least comprises a first plate, a second plate, a third plate and a fourth plate;

no hole is provided in an inside of an inner ring of a loop of a fourth corner portion of the first plate, and/or no hole is provided in an inside of an inner ring of a loop of a fourth corner portion of the second plate;

a distance between the first side plate and the first plate is less than a distance between the first side plate and the fourth plate; the heat exchanger comprises a first perforated member, a second perforated member, a third perforated member, a fourth perforated member, a fifth perforated member and a sixth perforated member; the first perforated member is arranged at a position of the first side plate corresponding to the second corner portion of the first plate; the second perforated member is arranged at a position of the first side plate corresponding to a third corner portion of the first plate; the third perforated member is arranged at a position of the second side plate corresponding to a second corner portion of the fourth plate; the fourth perforated member is arranged at a position of the second side plate corresponding to a third corner portion of the fourth plate; the fifth perforated member is arranged at a position of the first side plate corresponding to the fourth corner portion of the first plate; the sixth perforated member is arranged at a position of the second side plate corresponding to a fourth corner portion of the fourth plate; and the fifth perforated member is connected to the liquid reservoir;

while the heat exchanger is working, fluids flowing in the heat exchanger comprise a first heat exchange medium and a second heat exchange medium, the first heat exchange medium flows in via the first perforated member and flows out via the fifth perforated member, the first heat exchange medium flows into the liquid reservoir after flowing out of the fifth perforated member, and the first heat exchange medium flows in via the sixth perforated member after flowing out of the liquid reservoir and flows out via the fourth perforated member; the second heat exchange medium flows in via the third perforated member and flows out via the second perforated member; or the first heat exchange medium flows in via the fourth perforated member and flows out via the sixth perforated member, the first heat exchange medium flows into the liquid reservoir after flowing out of the sixth perforated member, and the first heat exchange medium flows in via the fifth perforated member after flowing out of the liquid reservoir and flows out via the first perforated member; the second heat exchange medium flows in via the second perforated member and flows out via the third perforated member.

* * * * *